US012746440B2

(12) United States Patent
Paselk et al.

(10) Patent No.: US 12,746,440 B2
(45) Date of Patent: Sep. 29, 2026

(54) PICKLEBALL PADDLE HAVING INTEGRAL HANDLE AND RIM ASSEMBLY

(71) Applicant: KARSTEN MANUFACTURING CORPORATION, Phoenix, AZ (US)

(72) Inventors: Justin A. Paselk, Phoenix, AZ (US); Jordan D. Shoenhair, Scottsdale, AZ (US); Clayson C. Spackman, Scottsdale, AZ (US); Erik M. Henrikson, Phoenix, AZ (US); Isaac P. Dukes, Phoenix, AZ (US); John A Solheim, Phoenix, AZ (US); Matthew A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 120 days.

(21) Appl. No.: 18/791,334

(22) Filed: Jul. 31, 2024

(65) Prior Publication Data

US 2025/0041685 A1 Feb. 6, 2025

Related U.S. Application Data

(60) Provisional application No. 63/557,390, filed on Feb. 23, 2024, provisional application No. 63/613,665, filed on Dec. 21, 2023, provisional application No. 63/516,825, filed on Jul. 31, 2023.

(51) Int. Cl.

| | |
|---|---|
| ***A63B 59/42*** | (2015.01) |
| ***A63B 60/54*** | (2015.01) |
| *A63B 102/08* | (2015.01) |

(52) U.S. Cl.

CPC ..... *A63B 59/42* (2015.10); *A63B 60/54* (2015.10); *A63B 2102/08* (2015.10); *A63B 2209/02* (2013.01)

(58) Field of Classification Search

CPC ..... A63B 59/42; A63B 60/54; A63B 2102/08; A63B 2209/02

USPC ..... 473/527

See application file for complete search history.

(56) References Cited

U.S. PATENT DOCUMENTS

| | | | |
|---|---|---|---|
| 1,961,473 | A | 6/1934 | Baltzley |
| 3,840,230 | A | 10/1974 | Schaefer |
| 3,879,035 | A | 4/1975 | Danchulis |
| 4,062,541 | A | 12/1977 | Marks |

(Continued)

FOREIGN PATENT DOCUMENTS

| | | |
|---|---|---|
| CN | 209564587 | 11/2019 |
| CN | 201920165270 | 11/2019 |

(Continued)

OTHER PUBLICATIONS

"The Ultimate Guide on Pickleball Paddle Cores," Date Accessed: Oct. 18, 2024, https://www.justpaddles.com/blog/post/pickleball-paddle-cores/.

(Continued)

*Primary Examiner* — Michael G Lee

(57) ABSTRACT

A pickleball paddle having an injection molded multi-piece frame surrounding and supporting a hitting face assembly. The frame provides design flexibility to separate control of the paddle stiffness from the playability characteristics of hitting face assembly. Speed of assembly is increased and cost of components are decreased by utilizing an injection molded frame.

20 Claims, 24 Drawing Sheets

(56) References Cited

U.S. PATENT DOCUMENTS

| | | | | |
|---|---|---|---|---|
| 4,353,550 | A | 10/1982 | Krosnick | |
| 4,355,803 | A | 10/1982 | Rama | |
| 4,379,554 | A | 4/1983 | Schuyler | |
| 4,684,131 | A | 8/1987 | Mortvedt | |
| 5,961,404 | A | 10/1999 | Gormley | |
| 6,213,902 | B1 | 4/2001 | Hagey | |
| 6,461,259 | B1 | 10/2002 | Li | |
| 6,551,206 | B2 | 4/2003 | Ha | |
| 6,974,397 | B2 | 12/2005 | Lammer | |
| 7,008,338 | B2 | 3/2006 | Pearson | |
| 7,160,286 | B2 | 1/2007 | Lammer | |
| 7,204,770 | B2 | 4/2007 | Mithieux | |
| 7,402,117 | B2 | 7/2008 | Wang | |
| 7,963,868 | B2 | 6/2011 | McGrath | |
| 8,298,101 | B2 | 10/2012 | Babolat | |
| 8,342,989 | B2 | 1/2013 | Lammer | |
| 8,371,969 | B2 | 2/2013 | Berton | |
| 8,894,517 | B2 | 11/2014 | Lammer | |
| 9,656,130 | B2 | 5/2017 | Lammer | |
| 10,377,093 | B2 | 8/2019 | Filippini | |
| 10,864,418 | B2 | 12/2020 | Kapheim | |
| 11,597,169 | B2 | 3/2023 | Simmons | |
| 11,612,792 | B2 | 3/2023 | Marshall | |
| D994,059 | S | 8/2023 | Jin | |
| 2003/0037058 | A1 | 2/2003 | Hatori | |
| 2003/0069096 | A1 | 4/2003 | Lin | |
| 2016/0184678 | A1 | 6/2016 | Bramhall | |
| 2016/0250533 | A1 | 9/2016 | O'Rourke | |
| 2017/0021247 | A1 | 1/2017 | Marvin | |
| 2017/0021248 | A1 | 1/2017 | Marvin | |
| 2017/0136325 | A1 | 5/2017 | Fox | |
| 2017/0282030 | A1 | 10/2017 | Foortse | |
| 2017/0348573 | A1 | 12/2017 | Zhou | |
| 2018/0304132 | A1 | 10/2018 | Epp | |
| 2021/0252356 | A1 | 8/2021 | Thurman | |
| 2021/0260452 | A1 | 8/2021 | Zheng | |
| 2022/0032141 | A1 | 2/2022 | Brents | |
| 2022/0040937 | A1* | 2/2022 | Simmons | B29C 70/68 |
| 2022/0088449 | A1* | 3/2022 | Marshall | A63B 59/42 |
| 2022/0273997 | A1 | 9/2022 | Zheng | |
| 2023/0191215 | A1 | 6/2023 | Barnes | |
| 2023/0264083 | A1 | 8/2023 | Frankel | |
| 2023/0293961 | A1 | 9/2023 | Haut | |
| 2023/0356048 | A1 | 11/2023 | Junkins | |
| 2023/0405426 | A1* | 12/2023 | Patel | A63B 59/42 |
| 2024/0017141 | A1 | 1/2024 | Filippini | |
| 2024/0066371 | A1* | 2/2024 | Filippini | A63B 59/42 |
| 2024/0286014 | A1* | 8/2024 | Marks | A63B 60/42 |
| 2025/0269253 | A1* | 8/2025 | Barnes | A63B 59/42 |

FOREIGN PATENT DOCUMENTS

| | | | | |
|---|---|---|---|---|
| CN | 112121380 | | 12/2020 | |
| CN | 114654825 | | 6/2022 | |
| CN | 115228064 | | 10/2022 | |
| CN | 116585678 | | 8/2023 | |
| CN | 117504254 | | 2/2024 | |
| CN | 118059452 | | 5/2024 | |
| CN | 118217608 | | 9/2024 | |
| CN | 118649403 | | 9/2024 | |
| DE | 102011008320 | | 7/2012 | |
| EP | 3501613 | | 6/2019 | |
| EP | 4122557 | | 1/2023 | |
| EP | 4245383 | | 9/2023 | |
| EP | 4295927 | | 12/2023 | |
| EP | 4154950 | | 7/2024 | |
| KR | 20230096150 | A * | 6/2023 | A24B 3/10 |
| KR | 20240037204 | | 3/2024 | |
| TW | 202327702 | | 7/2023 | |
| WO | 2015192768 | | 12/2015 | |
| WO | 2016046467 | | 3/2016 | |
| WO | 2022182992 | | 9/2022 | |
| WO | 2022217045 | | 10/2022 | |
| WO | 2023091652 | | 5/2023 | |
| WO | 2024076417 | | 4/2024 | |
| WO | 2024112661 | | 5/2024 | |
| WO | WO-2025090772 | A1 * | 5/2025 | A63B 60/002 |

OTHER PUBLICATIONS

"What is the Best Core Material for Pickleball?," Date Accessed: Oct. 18, 2024, https://pickleballstudio.com/blog/how-to-pick-the-core-thickness-of-your-pickleball-paddle-6sa64.

"Gel-Core Technology," Date Accessed: Oct. 18, 2024, https://players-pickleball.myshopify.com/pages/gel-core-technology?srsltid=AfmBOooO0TuerRXfG6LwH_z5zi7zPYJOY8buCfpnLADws7wwe4wkW8HD.

"Pickleball scores with the help of ceramic paddles," Date Accessed: Oct. 18, 2024, https://ceramics.org/ceramic-tech-today/pickleball-scores-with-the-help-of-ceramic-paddles/.

"Franklin Sports Pickleball Paddle—Titus + Jet Aluminum Plated Pickleball Paddles—USA Pickleball (USAPA)Approved Paddle—8mm Thick Core" Date Accessed: Oct. 18, 2024, https://www.amazon.com/Franklin-Sports-Pickleball-Paddle-Aluminum/dp/B07W22VLKT/ref=asc_df_B07W22VLKT/?tag=&linkCode=df0&hvadid=385124916409&hvpos=&hvnetw=g&hvrand=17662892490775089669&hvpone=&hvptwo=&hvqmt=&hvdev=c&hvdvcmdl=&hvlocint=&hvlocphy=9029988&hvtargid=pla-825705901089&ref=&adgrpid=8536808.

"Adidas Adipower Ctrl 2 Pickleball Paddle" Date Accessed: Oct. 18, 2024, https://pickleballcentral.com/adidas-adipower-ctrl-2-pickleball-paddle/.

"BEWE E1-52 Titanium Wire Pickleball Paddle," Date Accessed: Oct. 18, 2024, https://www.bewesport.com/bewe-e1-52-titanium-wire-pickleball-paddle-product/.

* cited by examiner

PICKLEBALL PADDLE HAVING INTEGRAL HANDLE AND RIM ASSEMBLY

CROSS REFERENCE PRIORITIES

This application claims the benefit of U.S. Provisional Application No. 63/516,825, filed Jul. 31, 2023, U.S. Provisional Application No. 63/613,665, filed Dec. 21, 2023, and U.S. Provisional Application No. 63/557,390, filed Feb. 23, 2024 the contents of which are fully incorporated herein by reference.

TECHNICAL FIELD

This application generally relates to pickleball equipment, and more particularly, to pickleball paddles.

BACKGROUND

Current methods of manufacturing pickleball paddles often include fabricating a core which serves as a platform upon which all other paddle components are assembled. These methods often further include fabricating a handle, an edge guard, and face plate as separate components which are subsequently attached to the core to form the paddle. One drawback of manufacturing pickleball paddles according to these methods is that the core must be sufficiently rigid to support the paddle. Therefore, core rigidity and stiffness are prioritized while other performance characteristics during play, as it contacts a ball, become secondary considerations, often reliant solely on design of the face plate. Further, since the core and face plate are typically the most expensive and most difficult paddle components to produce, it would be desirous to drive performance characteristics using less expensive components of the paddle. Thus, there is need in the art for pickleball paddles having improved manufacturability, reduced cost, and improved performance characteristics.

BRIEF DESCRIPTION OF THE DRAWINGS

To facilitate further description of the embodiments, the following drawings are provided in which.

DEFINITIONS

Figure 1:
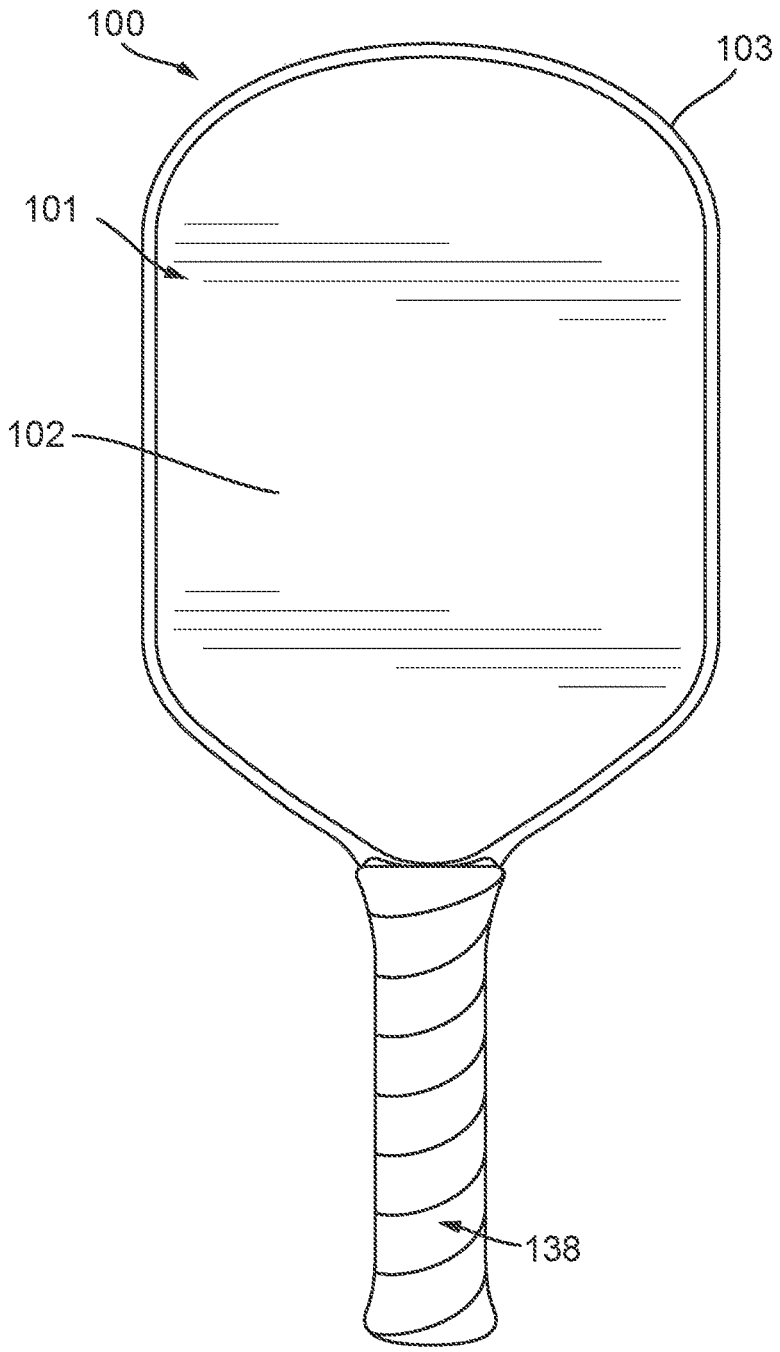
FIG. 1 illustrates a front view of a pickleball paddle according to an embodiment of the present disclosure.
Figure 2:
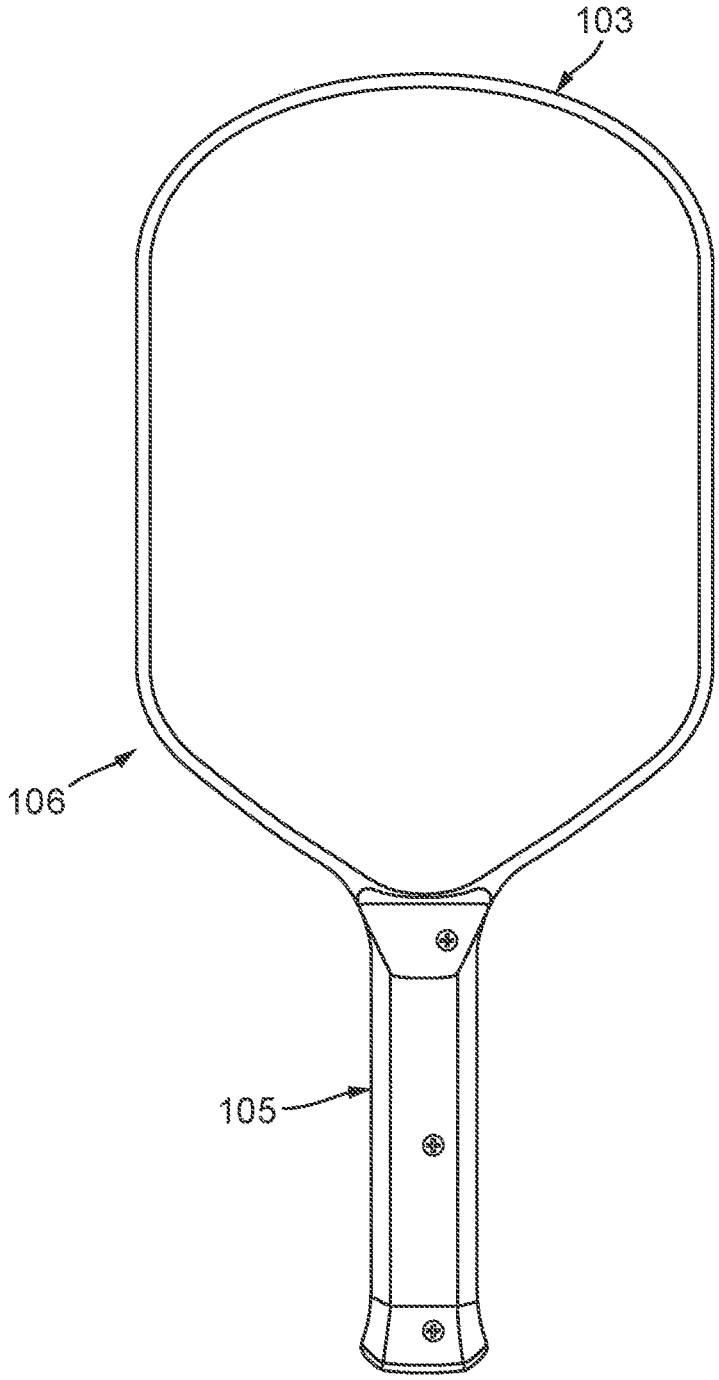
FIG. 2 illustrates a front view of a pickleball paddle of FIG. 1 with the head subassembly and grip removed.

For simplicity and clarity of illustration, the drawing figures illustrate the general manner of construction, and descriptions and details of well-known features and techniques may be omitted to avoid unnecessarily obscuring the paddle. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein.

Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "front," "back," "top," "bottom," "over," "under," "north," "south," "east," "west," and the like in the description and in the claims, if any, are used for descriptive purposes and not necessarily for describing permanent relative positions. It is to be understood that the terms so used are interchangeable under appropriate circumstances such that the embodiments of the paddle described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "geometric centerpoint," or "geometric center" of the face plate, as used herein, can refer to a geometric centerpoint of the face plate perimeter, and at a midpoint of the face height of the face plate.

The "length" of the pickleball paddle head, as described herein, can be defined as a top-to-bottom dimension of the pickleball paddle. In many embodiments, the length of the paddle can be measured according to a pickleball governing body such as USA PICKLEBALL.

The term "face plate" of the pickleball paddle, as described herein, can refer to one or both of the face plates. The face plate is positioned external relative to the core, and may be externally exposed or may be covered by a hitting surface.

The term "coupling plane," as used herein, can refer to an imaginary plane parallel to the face plates and centered between the face plates.

The term "internal cavity" refers to the void defined by the interior surfaces of the first and second frame members.

DESCRIPTION

Pickleball paddles described herein have improved performance characteristics and manufacturability. More specifically, a structural frame reduces the need for the core of the paddle to also have the same rigidity and impact performance characteristics. Accordingly, the core may instead be designed primarily for impact performance, while the structural frame is configured for rigidity. Additionally, the structural frame can be formed using manufacturing techniques such as injection molding, co-molding, or additive manufacturing which are cost and time effective. These manufacturing techniques can be used to form complex geometries without incurring significant costs. Therefore, reinforcing structures can be added to the structural frame which enable the frame to be both rigid and lightweight. Reducing the need for the paddle core to be rigid and including a rigid and lightweight structural frame creates significant mass savings. Additional discretionary mass created by implementing a structural frame can then be strategically implemented elsewhere to improve paddle impact performance. For example, discretionary mass can be placed around the paddle perimeter to increase paddle moment of inertia and/or alter the location of the paddle's center of gravity.

I. Multi-Component Frame

Disclosed herein are embodiments of a pickleball paddle comprising a multi-component frame that structurally supports a head subassembly (101, 201) to provide a sufficiently rigid paddle (100, 200). In one embodiment, as shown in FIGS. 10 and 16-24, the multi-component frame 106 comprises two frame members (218, 219) that are bonded together and encase the periphery of a paddle head subassembly (101, 201). In another embodiment, as shown in FIGS. 1-5, the multi-component frame comprises a single piece rim (103, 203) that wraps around a paddle head subassembly (101, 201) and comprises a handle support member 139 that is received by a separate handle 105.

Figure 20:
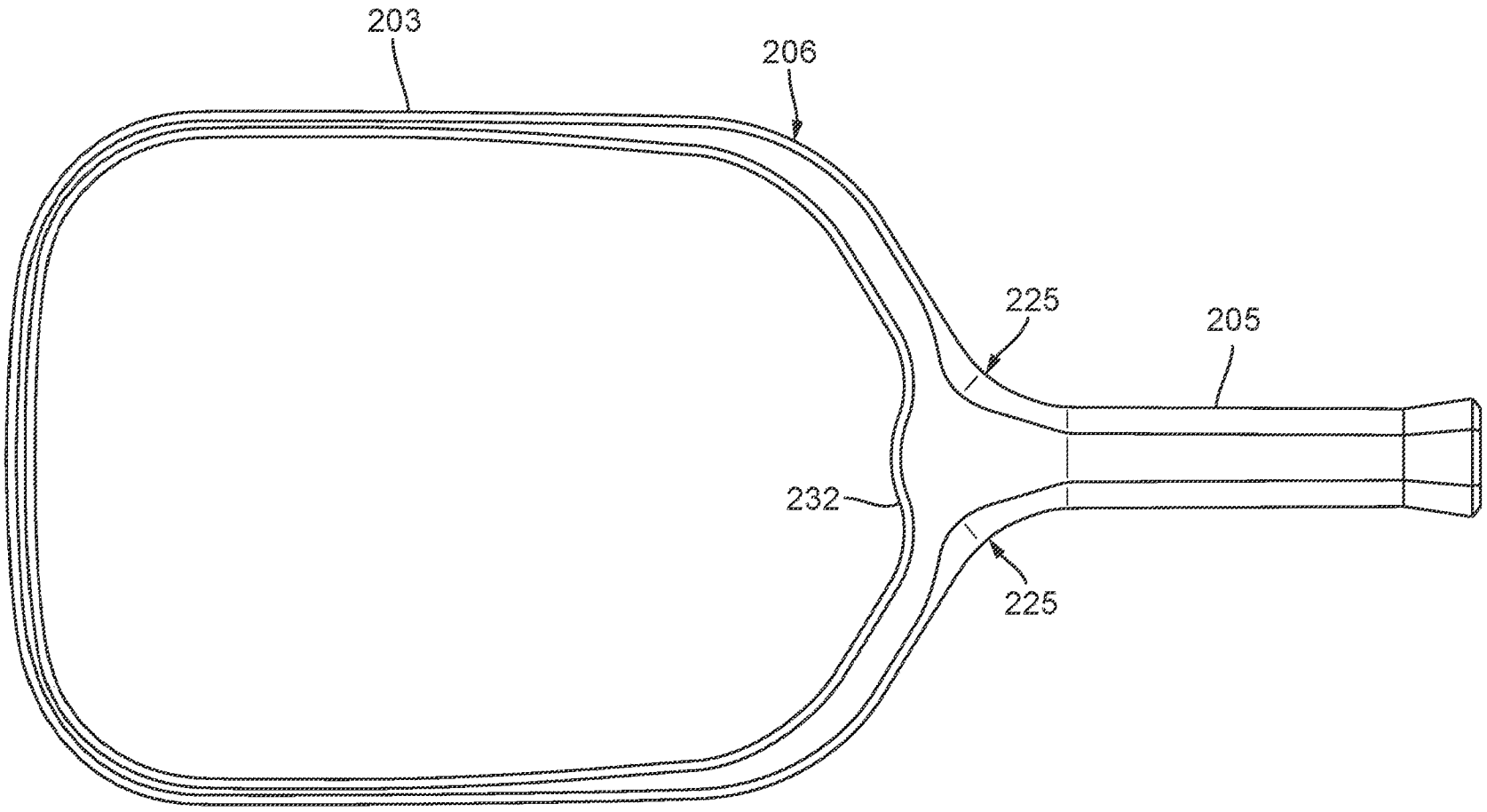
FIG. 20 illustrates a front view of the pickleball paddle frame of FIG. 10.
Figure 26:
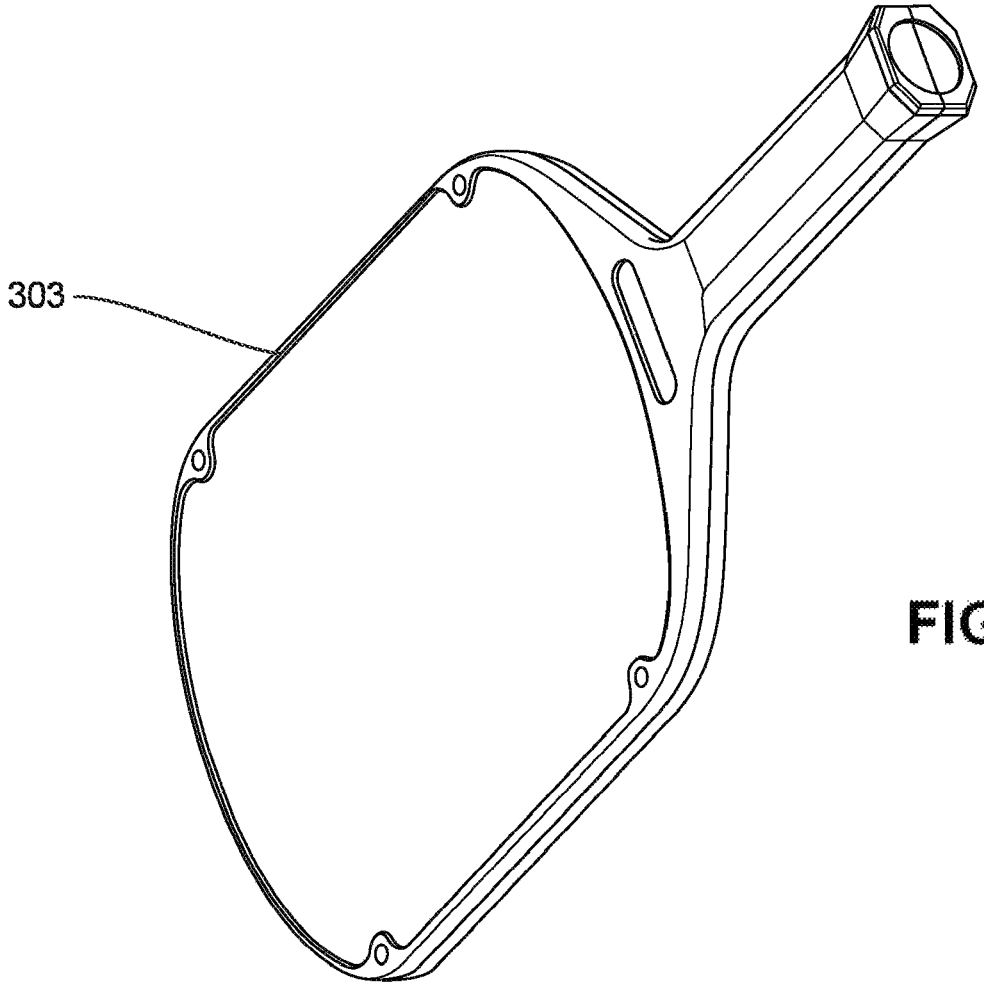
FIG. 26 illustrates a front view of the pickleball paddle frame of FIG. 25.

Referring to FIGS. 1, 20, and 26, the pickleball paddle (100, 200) can comprise a head subassembly (101, 201) and a frame (106, 206). The head subassembly (101, 201) comprises two face plates (102, 202), and a core which are joined together. The face plates (102, 202) are joined to opposite sides of the core (104, 204) and can form surfaces that impact with the ball during play. The core (104, 204) is sandwiched between the face plates (102, 202). The edges of the core (104, 204) not covered by the face plates (102, 202) comprise a core (104, 204) perimeter portion.

The head subassembly (101, 201) is joined to the frame (106, 206), which supports the head subassembly (101, 201) and imparts structural rigidity to the pickleball paddle. The frame (106, 206) controls a majority of overall paddle (100, 200) stiffness. The frame (106, 206) includes both a rim (103, 203), which at least partially surrounds the head subassembly (101, 201), and a handle (105, 205) for gripping the paddle (100, 200). The rim (103, 203) and handle (105, 205) together define a perimeter of the frame (106, 206). The handle (105, 205) can be attached to or formed integrally with the rim (103, 203). The handle (105, 205) and rim (103, 203) can also be joined by a throat (116, 216). The throat (116, 216) provides a transition region between the handle and rim (103, 203), which can reduce stress concentrations where the handle (105, 205) and rim (103, 203) meet.

The pickleball paddle (100, 200) can comprise a maximum paddle length measured from a distal handle end or butt end to a topmost rim exterior point. The paddle length can be in a range of 14 inches to 17.5 inches. The paddle length may be 14.0 inches, 14.5 inches, 15.0 inches, 15.5 inches, 16.0 inches, 16.5 inches, 17.0 inches, or 17.5 inches. The pickleball paddle (100, 200) can comprise a maximum paddle width measured perpendicular to the paddle length. The paddle width can be in a range of 6.5 inches to 8.5 inches. The paddle width may be 6.5 inches, 7.0 inches, 7.5 inches, 8.0 inches, or 8.5 inches.

Figure 3:
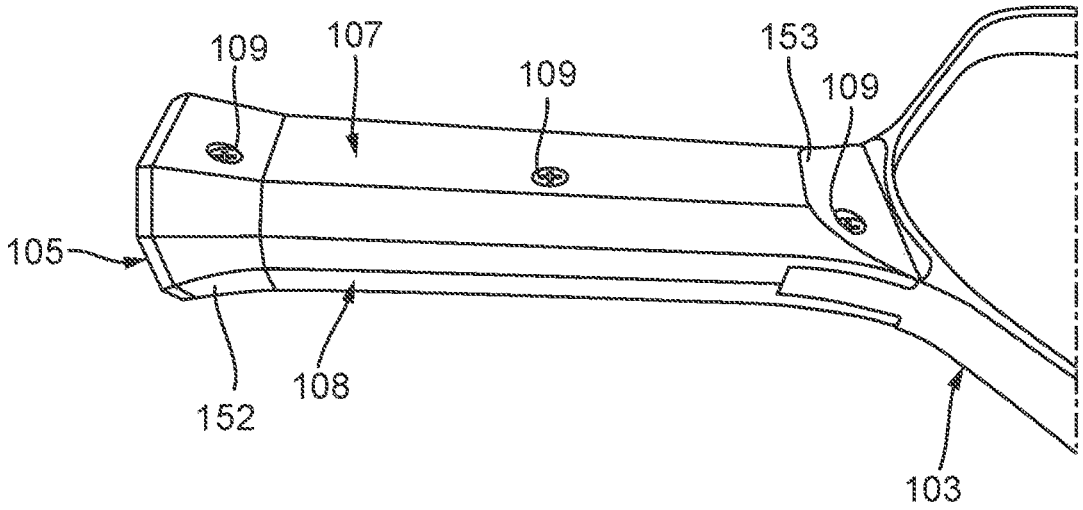
FIG. 3 illustrates an enlarged detail view of the handle of the pickleball paddle illustrated in FIG. 2.
Figure 7:
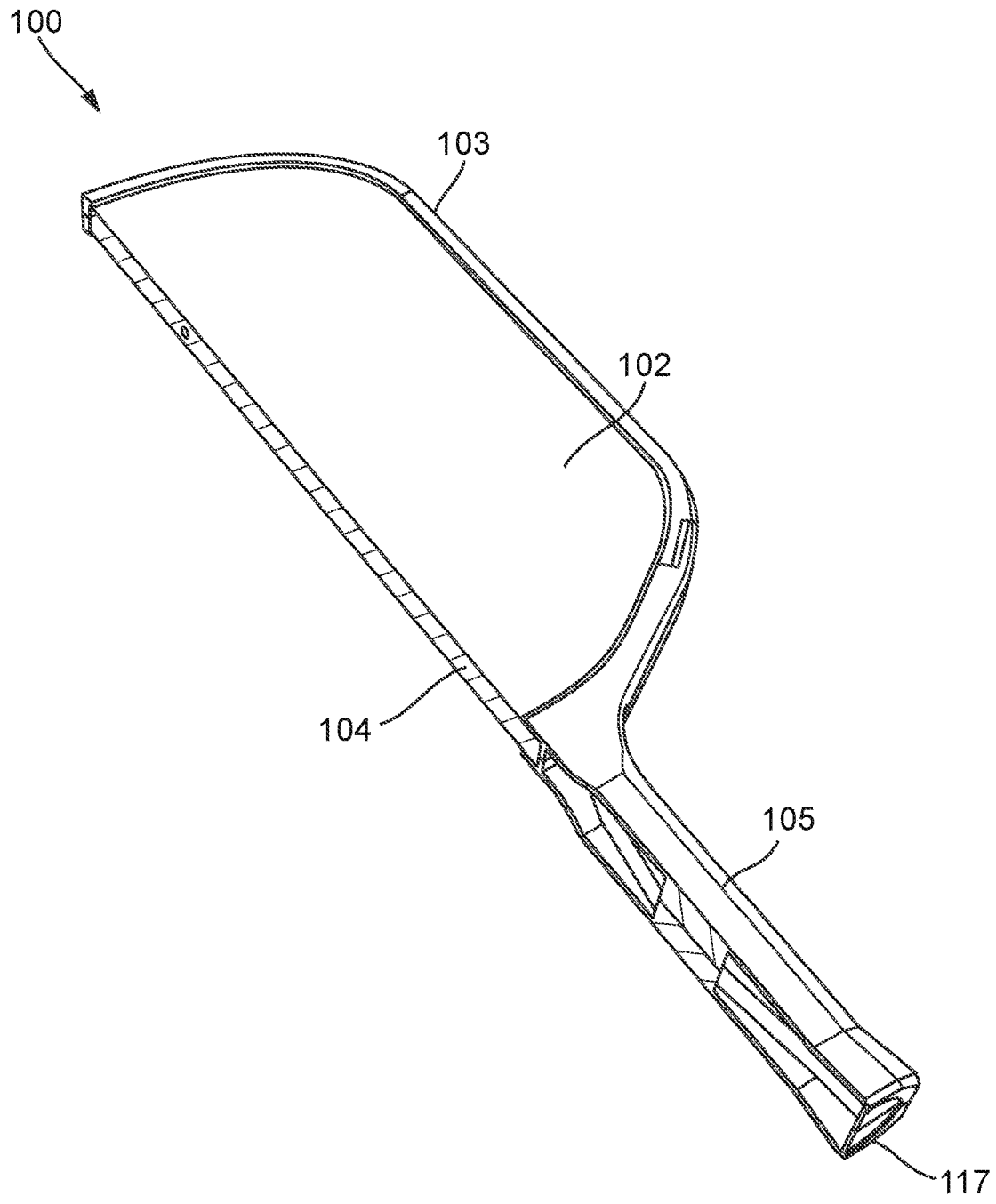
FIG. 7 illustrates a cross-sectional view of the pickleball paddle of FIG. 6, sectioned along the longitudinal plane.

The handle (105,205) can provide the user with a surface that can be used to grip the paddle. In some embodiments the handle (105, 205) can include a grip 138 which is overlaid on the handle to improve comfort, as discussed in further detail below. The handle can include an end cap (117) proximate the distal end of the paddle, as shown in FIG. 7. Additionally, the handle can comprise several geometries to improve player comfort and ensure the player does not drop the paddle during play. As shown in FIG. 3, the handle can include a first handle transition surface 152 where the handle (105, 205) tapers from its largest size proximate the distal handle end. The handle (105, 205) can further include a second handle transition surface 153 where the handle (105, 205) ends and the throat (116, 216) begins.

Figure 6:
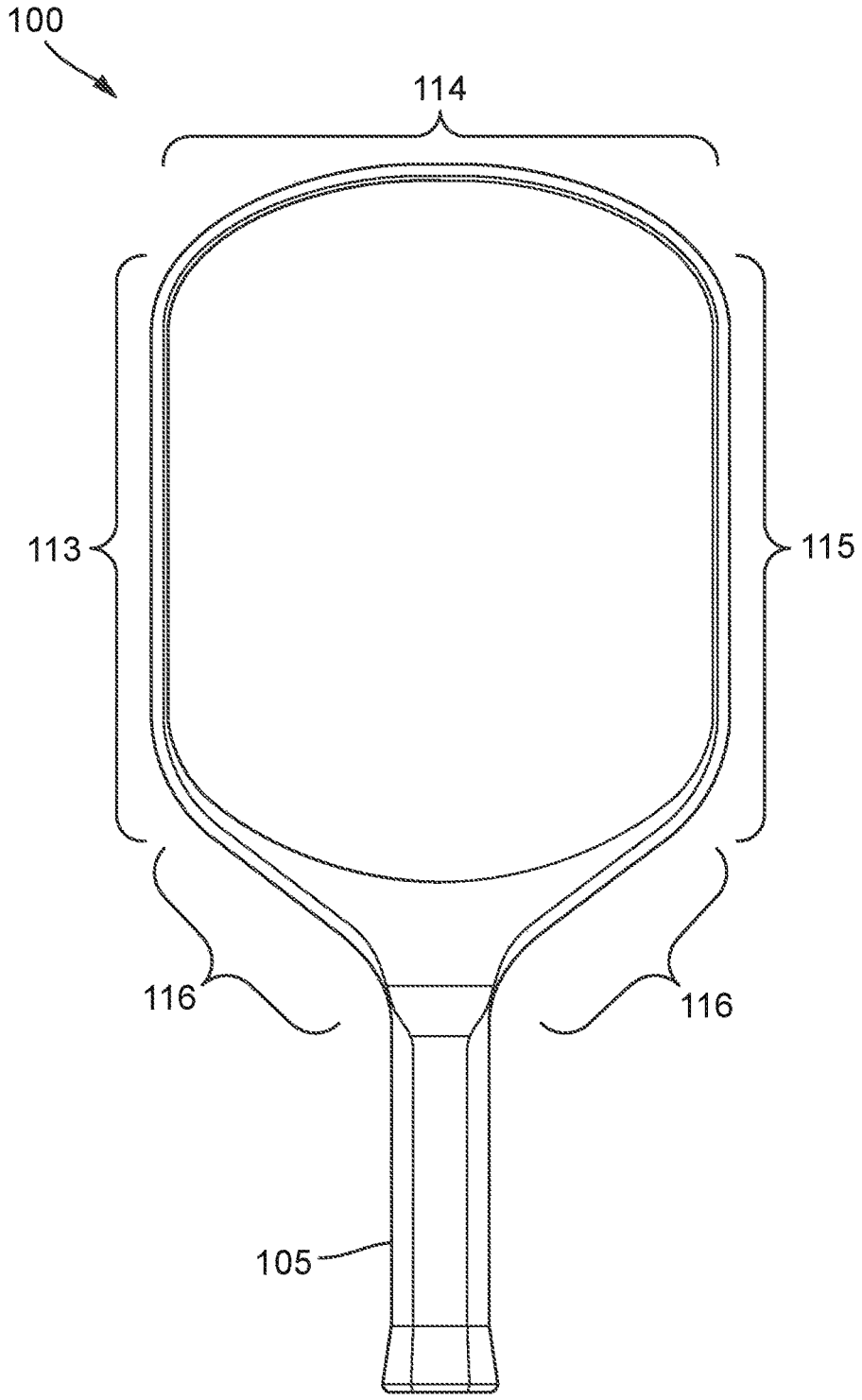
FIG. 6 illustrates a front view of a pickleball paddle frame according to another embodiment.

As shown in FIG. 6, the rim (103, 203) can comprise four regions: a top region 114, a second lateral region 115, a first lateral region 113, and a throat (116, 216). These four regions form a continuous rim (103, 203) which partially encases the core material. Each of the subcomponents of the rim (103, 203) can be formed separately to facilitate manufacturing and assembly. Alternatively the four subcomponents can be integrally formed to improve the rigidity of the frame. In some embodiments, as best shown in FIGS. 10 and 18-20, the rim (103, 203) can be formed as two halves, which are then joined together. A portion of the frame can define a 'Y' shape, including the handle 205 or handle support 139, the throat (116, 216), and the first and second lateral regions (113, 115). The throat (116, 216) comprises a throat maximum width and a throat maximum length. The throat maximum length is measured along the longitudinal plane from the topmost portion of the second handle transition surface 153 to the rim inner perimeter surface. The throat maximum length is in the range of 0.75 inch to 1.50 inches. The throat maximum length may be 0.75 inch, 0.80 inch, 0.85 inch, 0.90 inch, 0.95 inch, 1.00 inch, 1.05 inches, 1.10 inches, 1.15 inches, 1.20 inches, 1.25 inches, 1.30 inches, 1.35 inches, 1.40 inches, 1.45 inches, or 1.50 inches. The throat maximum width is measured from the internal rim points on each side of the longitudinal plane where the bonding surface width transitions to the throat such that the bonding surface width is increasing moving toward the longitudinal plane. The maximum throat width is in a range of 1.5 inches to 2.5 inches. The maximum throat width may be 1.5 inches, 1.6 inches, 1.7 inches, 1.8 inches, 1.9 inches, 2.0 inches, 2.1 inches, 2.2 inches, 2.3 inches, 2.4 inches, or 2.5 inches.

In some embodiments, the core (104, 204) comprises an extension enclosed within the interior of the throat (116, 216). In some embodiments, the extension entirely fills the interior of the throat, whereas in other embodiments the extension stretches only partially into the throat (116, 216). In other embodiments, the core (104, 204) does not comprise an extension which stretches into the interior of the throat (116, 216) and the core (104, 204) is contained entirely within the rim (103, 203).

As discussed above, the frame structurally supports the paddle and provides stiffness and rigidity to the paddle. Paddle stiffness and rigidity requirements are, in part, driven by the need to absorb the forces applied to the paddle during impact with a ball. These impact forces are transmitted from the face plates (102, 202) to the core (104, 204) during impact. To aid the core (104, 204) in absorbing impact forces, current paddles implement a core (104, 204) which extends into the paddle handle, where it is anchored by the user's grip. Consequently, these paddles require a core material that is sufficiently strong and durable to absorb impact forces. Furthermore, these forces may concentrate stresses in a region where the unsupported core meets core anchored in the handle. On the other hand, paddles constructed according to the present disclosure include a head subassembly (101, 201). The head subassembly (101, 201) can be mechanically or adhesively joined to the rim (103, 203). Joining the rim (103, 203) to the head subassembly (101, 201) allows impact forces to be transmitted from the face plates (102, 202) to the large surface area of the frame (106, 206). Thereby, as shown in FIG. 7, the core (104, 204) constructed according to the present disclosure does not have to extend into the handle for anchoring, thereby alleviating the issue of stress concentrations where unsupported core material meets core material anchored in the handle. By eliminating stress concentrations in the core and supporting the paddle with a structural frame the pickleball paddles disclosed herein can comprise a less rigid head subassembly (101, 201). Therefore, the head subassembly (101, 201) can be designed with a greater focus on paddle performance characteristics including feel, sound, forgiveness, spin, and power and less focus on rigidity.

A. Two-Component Frame

In some embodiments, the frame 206 (hereafter referred to as "a two-component structure frame") can be formed entirely from two-components to reduce manufacturing costs and increase frame 206 rigidity. A two-component structural frame 106 formed of two halves, wherein each half comprises a rim 203 portion and a handle portion, is illustrated in FIGS. 8 and 10-20. This simple two-component frame construction facilitates quick and easy assembly and production while providing necessary structural support to the paddle. The two halves engage each other along a mating surface and are mechanically or adhesively joined to the paddle head subassembly 201, thereby forming the outer surface of the paddle 200. In doing so, the present disclosure provides a two-component frame pickleball paddle 200 that is easier to manufacture by way of cost and time than existing designs, while maintaining desirable performance and feel properties.

In some embodiments, referring to FIGS. 8 and 10-20, the entire frame 106, including both the rim 203 and the handle, can be made up of two separate components. Specifically, the frame 106 can include a first frame member 218 and a second frame member 219 which are joined to form the rim 203 and handle 205 of the paddle. Each of the first and second frame members (218, 219) can include integrally formed halves of the rim 203 and handle. The first and second frame members (218, 219) can be coupled together along a frame mating surface 255 to form the frame 106. In these embodiments, each frame member (218, 219) can be identical or similar in structure. Since the paddle (100, 200) is formed by joining two similar portions together, manufacturing time and tooling can be reduced. Namely, a single mold can be used to form both portions. Identical two-component frame 206 construction can be used in combination with a wide variety of materials and structures for the head subassembly 201, strengtheners and reinforcers, fillers, and dampers. This enables modularity with the frame member (218, 219) that can be tailored for weighting, damping, and strengthening and creation of paddles with potentially different performance characteristics having the same frame member (218, 219).

Figure 19:
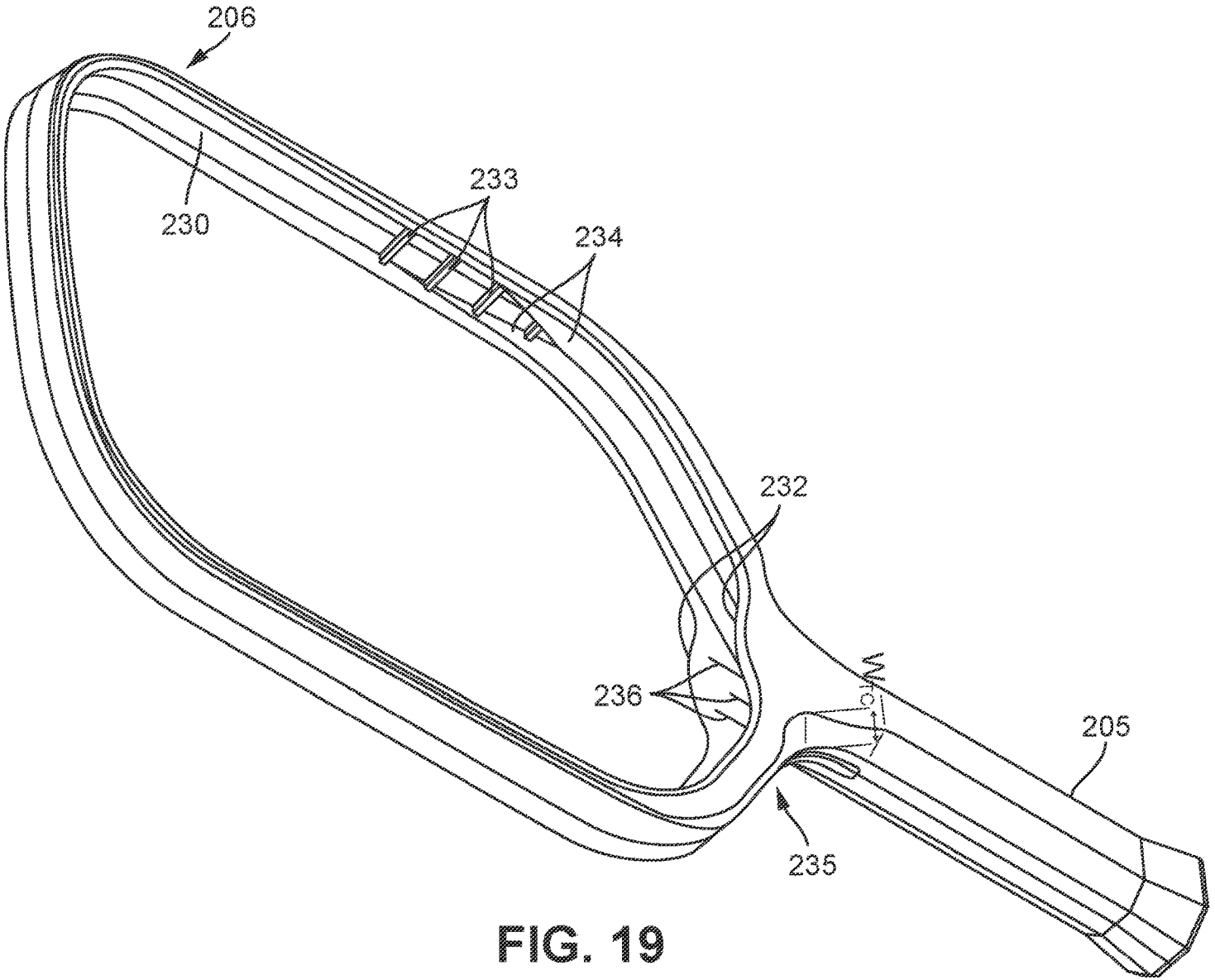
FIG. 19 illustrates an alternative isometric view of the pickleball paddle frame of FIG. 10.

Each frame member (218, 219) comprises an exterior side and an interior side. The exterior side forms a portion of the paddle outer surface. The interior side may include voids and/or structures, and is not visible on the fully assembled paddle. Each frame member (218, 219) comprises a front outer perimeter, a front inner perimeter, a rear outer perimeter, and a rear inner perimeter. Referring to FIG. 19, an outer rim wall 256 and an inner rim wall 257 connect to one another to form an angle between 60 degrees and 110 degrees. When the paddle 200 is assembled, the outer rim wall 256 of each frame member (218, 219) abuts the other along a mating surface between the interior side and the exterior side, and forms the paddle outer rim surface. Each outer rim wall 256 comprises an outer rim wall thickness. Each outer rim wall 256 comprises an outer rim wall 256 height. The outer rim wall 256 height for each frame is in a range of 0.30 inch to 0.50 inch. Each outer rim wall 256 height may be 0.30 inch, 0.35 inch, 0.40 inch, 0.45 inch, or 0.50 inch. The rear surface of each frame member outer rim wall is defined by the outer rim wall thickness, and may be adhesively secured to the matching outer rim wall rear surface of the opposing frame member when the paddle is assembled. The outer rim wall 256 thickness measured perpendicularly from a point on the exterior surface to the inner surface, and is in a range of 0.030 inch and 0.150 inch. The outer rim wall 256 thickness may be 0.030 inch, 0.040 inch, 0.50 inch, 0.60 inch, 0.70 inch, 0.80 inch, 0.90 inch, 0.100 inch, 0.110 inch, 0.120 inch, 0.130 inch, 0.140 inch, 0.150 inch.

When joined, the first frame member 218 and the second frame member can define an outer shell and an internal cavity 240. The internal cavity 240 can comprise reinforcing structures and/or dampening materials used to modify the feel and sound of the paddle, as discussed further below.

a) Internal Cavity Structures

In some embodiments, structures may be disposed within the internal cavity 240 to increase rigidity and/or improve one or more performance characteristics. These internal cavity structures can increase strength in high stress regions to prevent failure, and/or improve feel and sound. In some embodiments, the internal cavity structures may be damping structures or materials that reduce sound and damp vibration. Weight savings from the frame 106 construction may partially or entirely offset the weight of the internal cavity structures, thereby maintaining the same overall paddle weight.

As discussed above, the structurally supportive frame 106 disclosed herein reduces the burden traditionally placed on the core to serve as the paddle backbone. Therefore, internal cavity 240 construction, including core design, can prioritize impact performance characteristics instead of structural rigidity. As a result, structural material within the internal cavity 240 can be replaced with damping materials which damp sound and vibration. The damping materials can comprise foams, polymers, plastics, or the like. In one exemplary embodiment, the internal cavity structures can comprise a damping material comprised of cork. In another exemplary embodiment, the core can comprise a damping material comprised of injected acoustic foam. The damping material(s) can minimize vibrations to improve sound upon impact with a pickleball.

Referring to FIGS. 21-27, some internal cavity structures may be provided as one or more reinforcing structures 241. Reinforcing structures 241 formed within the internal cavity 240 can strengthen the frame 206 and absorb vibration without adding significant amounts of mass. Further, the reinforcing structures 241 can improve rigidity and durability of the paddle, and can be lightweight to increase available discretionary mass. Reinforcing structures 241 can comprise ribs, trusses, bars, channels, rods, beams, coils or the like that extend across the entire internal cavity 240 from one portion of the paddle rim 203 to another non-adjacent portion of the paddle rim 203. In some embodiments, the reinforcing structures 241 can be suspended, such that they do not contact either of the face plates (102, 202). In other embodiments, the reinforcing structures 241 can be suspended across the internal cavity 240 such that they do not contact any portion of the paddle rim 203. In one example, suspended reinforcing structures 241 can be positioned within the core (104, 204), and can extend from one face plate (102, 202) to the other face plate (102, 202). In another example, handle-nested reinforcing structures 241 which do not contact any portion of the paddle rim 203 can extend from the first handle member (107, 207) to the second handle member (108, 208) or otherwise across the handle (105, 205).

Figure 21:
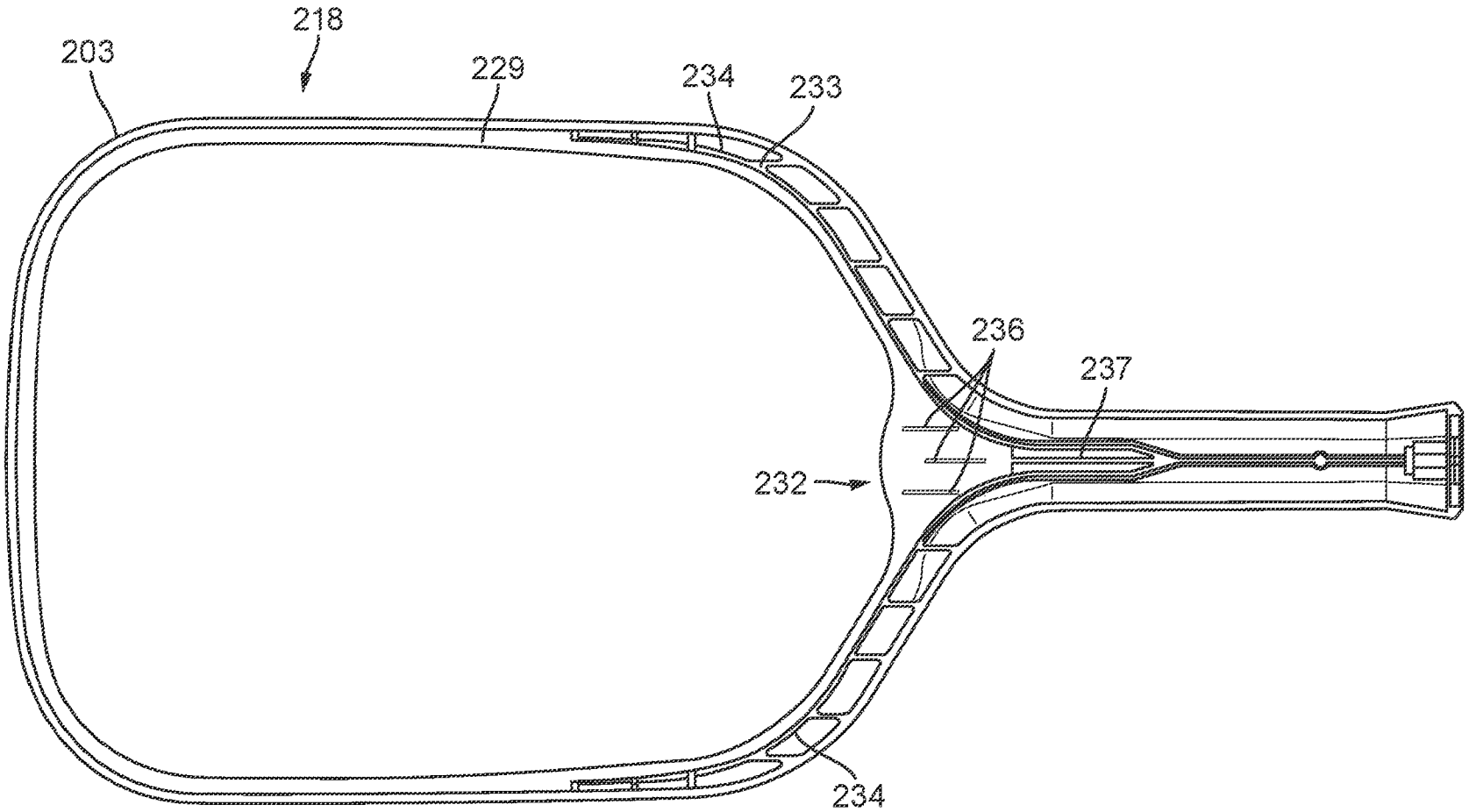
FIG. 21 illustrates a front view of the first frame member of the pickleball paddle of FIG. 10.
Figure 22:
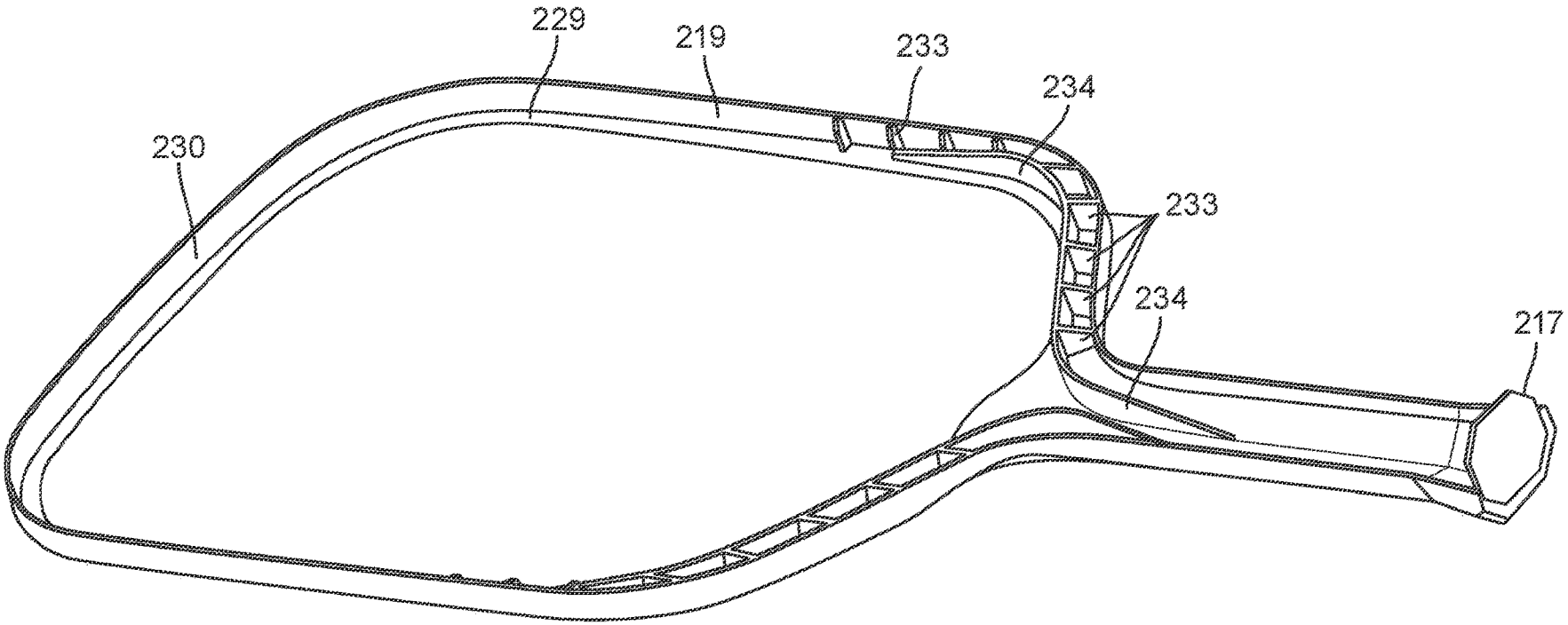
FIG. 22 illustrates an isometric view of the first frame member of the pickleball paddle of FIG. 10.
Figure 23:
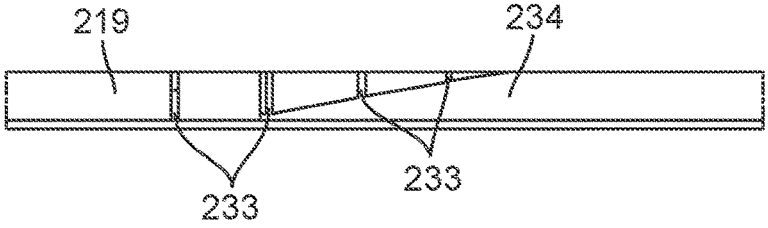
FIG. 23 illustrates an enlarged side view of the interior surface of the first frame member of the pickleball paddle of FIG. 10
Figure 24:
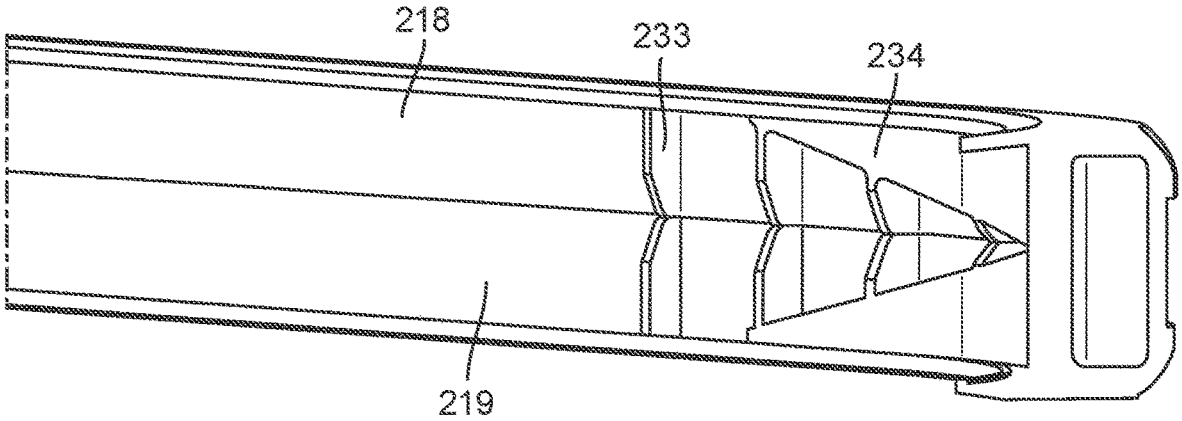
FIG. 24 illustrates an enlarged isometric view of the pickleball paddle frame of FIG. 10.

As discussed above, the structural frame disclosed herein is meant to be the primary means of support for the paddle and must be capable of withstanding impact forces and other loads associated with paddle use. When anchored by a user's hand placed on the grip, the paddle responds to loading similarly to a cantilevered beam. This creates high stress concentrations in the throat (116, 216) as well as the surrounding portions of the grip and rim. Therefore, reinforcing structures are particularly effective when placed proximate these high stress areas, as shown in FIGS. 21-22. A throat (116, 216) reinforcement wall 234 can be formed in the throat (116, 216) to provide additional rigidity and absorb stresses near the throat (116, 216). The throat (116, 216) reinforcement wall 234 can extend from the throat (116, 216) into the handle 205 and the rim 203 to provide support to these portions of the frame (106, 206). The throat (116, 216) reinforcement wall 234 can be integrally formed with the frame (106, 206). Additional reinforcement structures can be used in addition to the throat (116, 216) reinforcement wall 234 to more evenly distribute stresses throughout the frame (106, 206). As shown in FIGS. 21-22, ribs 233 can extend between the throat (116, 216) reinforcement wall 234, bonding surface 229, and/or lateral bonding surface 230. Forming the ribs 233 and/or throat (116, 216) reinforcement wall 234 such that they are integral with bonding surface 229 and/or lateral bonding surface 230 allows impact forces to be efficiently transferred from the striking face plates (102, 202) to the frame (106, 206).

The interior surface of the inner rim wall 257 can define the bonding surface 229. The interior surface of the outer rim wall 256 can define the lateral bonding surface 230. The lateral bonding surface 230 comprises a lateral bonding surface height in a range of 0.25 inch to 0.45 inch measured in an exterior surface to interior surface direction. The lateral bonding surface height may be 0.25 inch, 0.30 inch, 0.35 inch, 0.40 inch, or 0.45 inch. The bonding surface 229 comprises a bonding surface width measured in and exterior rim wall to interior rim wall direction perpendicular to the exterior rim wall in a range of 0.100 inch to 0.200 inch. The bonding surface width may be 0.100 inch, 0.110 inch, 0.120 inch, 0.130 inch, 0.140 inch, 0.150 inch, 0.160 inch, 0.170 inch, 0.180 inch, 0.190 inch, or 0.200 inch. The bonding surface width 229 may be constant around the rim perimeter, only changing when the bonding surface transitions to the throat 216.

Figure 25:
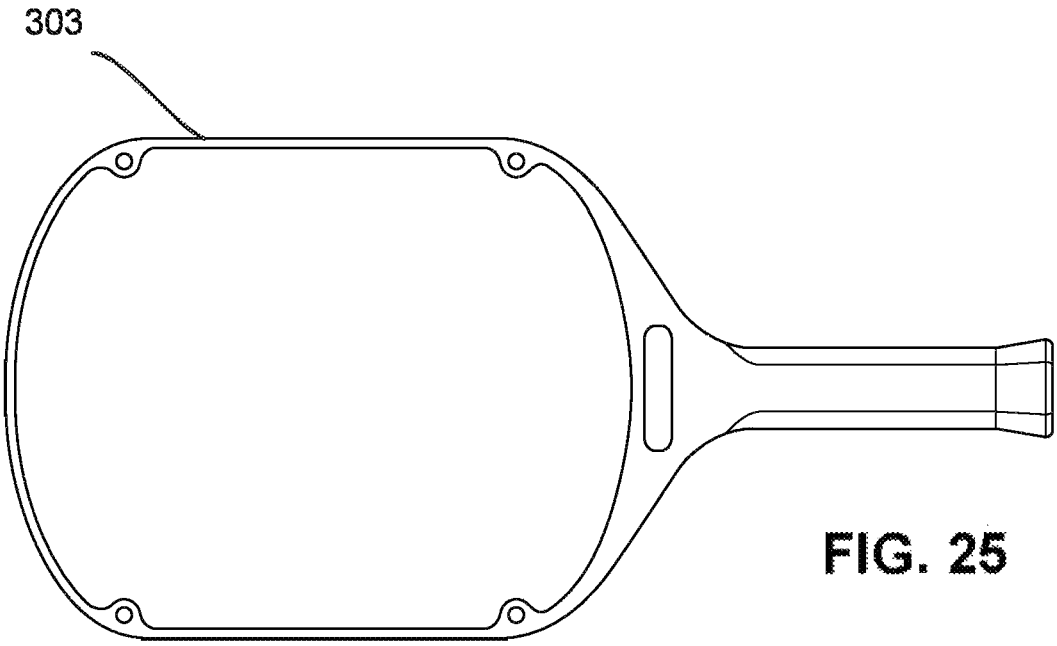
FIG. 25 illustrates an isometric view of a pickleball paddle frame, according to another embodiment.
Figure 27:
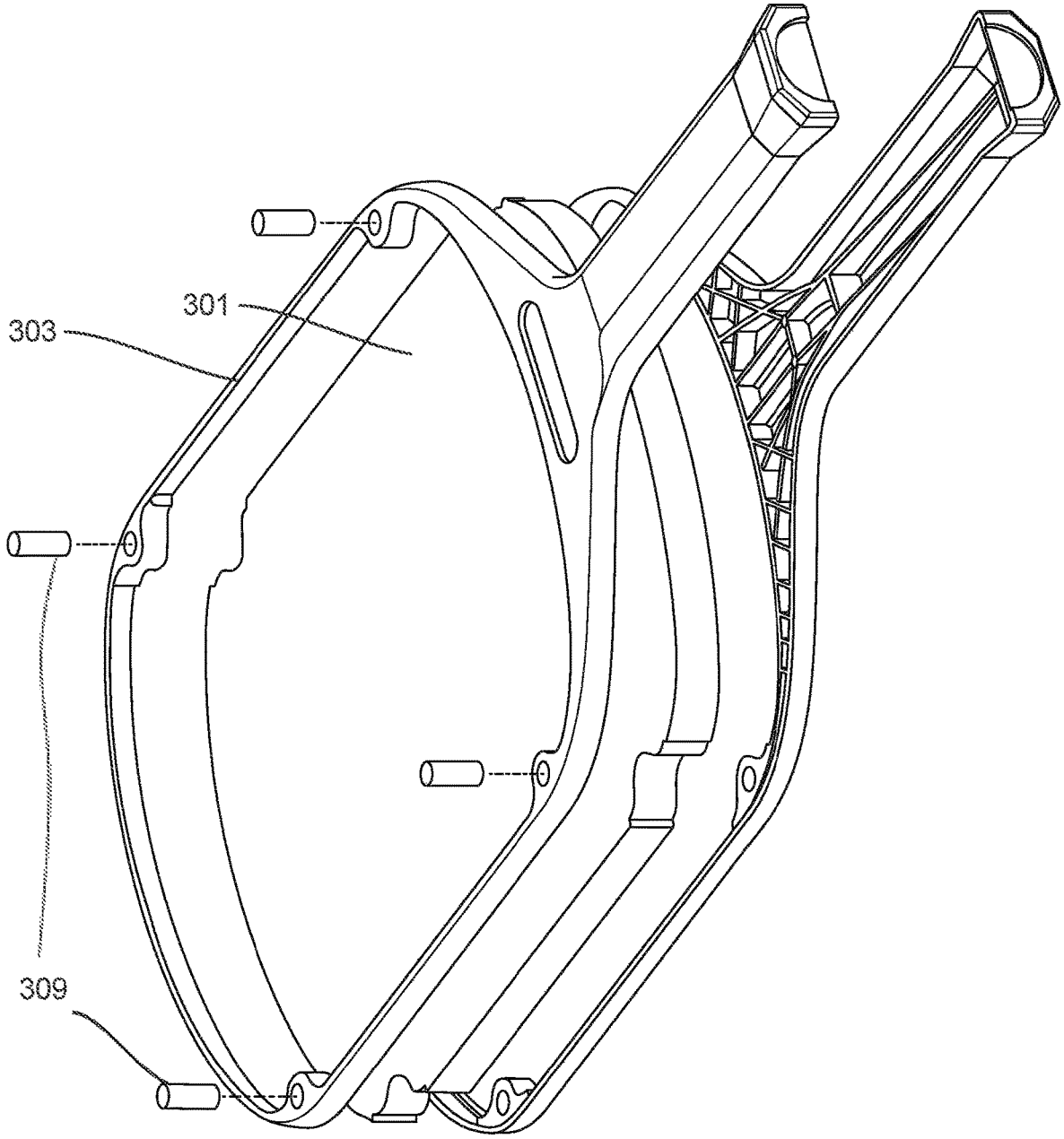
FIG. 27 illustrates an exploded view of the pickleball paddle frame of FIG. 25.

Additionally, as shown in FIGS. 25-27, a plurality of bosses 211 can be located within the cavity 240 defined by the first and second frame members (218, 219) to help guide and secure the first and second frame members (218, 219) together. The plurality of bosses can, for example, define bores (110, 210) and be configured to receive mechanical fasteners to secure the two halves of the frame together. In other embodiments, the frame members (218, 219) can be coupled by mechanical fasteners, ultrasonic welding, adhesives, or any other suitable method for coupling. In one embodiment, the one or more injection molded pieces can comprise the same thermoplastic resin component to allow bonding without the need for an intermediate adhesive. Bosses 211 similar to those illustrated in FIGS. 25-27 can be applied to either of the single rim paddle 100 or the multi-piece paddle 200.

As discussed in further detail below, frames which are mated to the paddle via adhesive means (such as epoxy) may require internal cavity structures which direct adhesive flow to ensure proper bonding and reduce the amount of epoxy needed. These internal cavity structures can include the bosses 211, ribs 233, or reinforcing structures (234, 244) discussed above. Alternatively, internal cavity structures dedicated to epoxy retention may be included, such as epoxy retention lip 228, best shown in FIG. 17. The epoxy retention lip 228 can prevent epoxy from spreading beyond the bonding surface 229. The epoxy retention lip 228 comprises an epoxy retention lip height measured perpendicular to the bonding surface interior surface. The epoxy retention lip height is in a range from 0.010 inch to 0.050 inch. The epoxy retention lip height may be 0.010 inch, 0.015 inch, 0.020 inch, 0.025 inch, 0.030 inch, 0.035 inch, 0.040 inch, 0.045 inch, or 0.050 inch.

II. Bonding

The multiple paddle parts described above can be coupled by way of any one or combination of the following methods: adhesive (such as epoxy or tape), heating and pressing, ultrasonic welding, mechanical fasteners, and mechanical locking or retaining structures.

A. Epoxy Bonding

Figure 17:
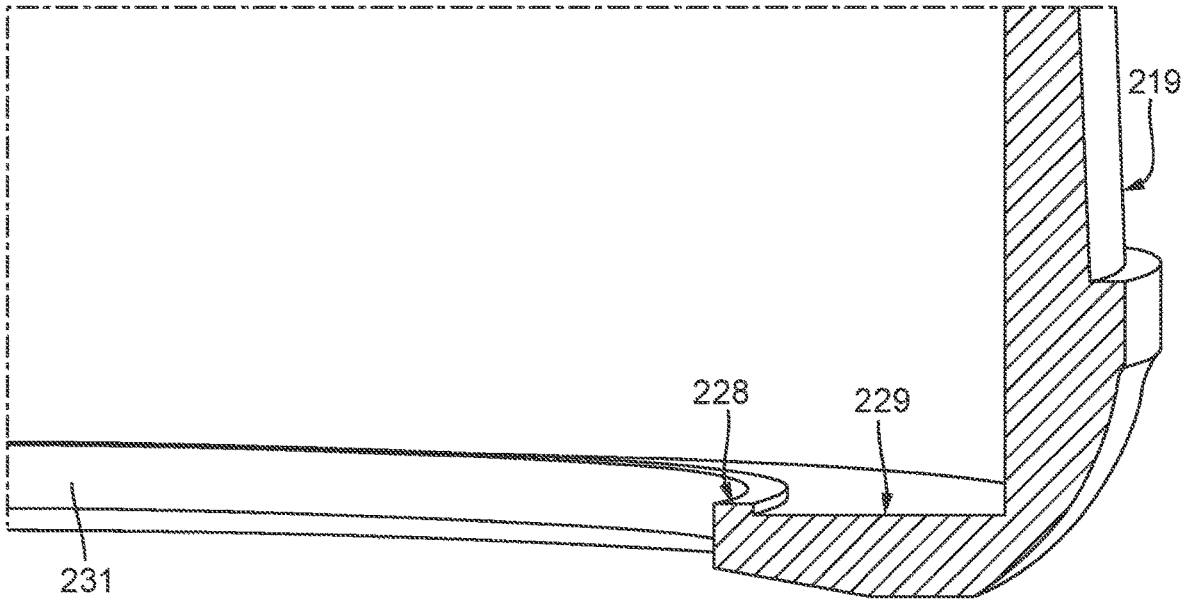
FIG. 17 illustrates an enlarged, partial cross-sectional view of the pickleball paddle frame of FIG. 15
Figure 18:
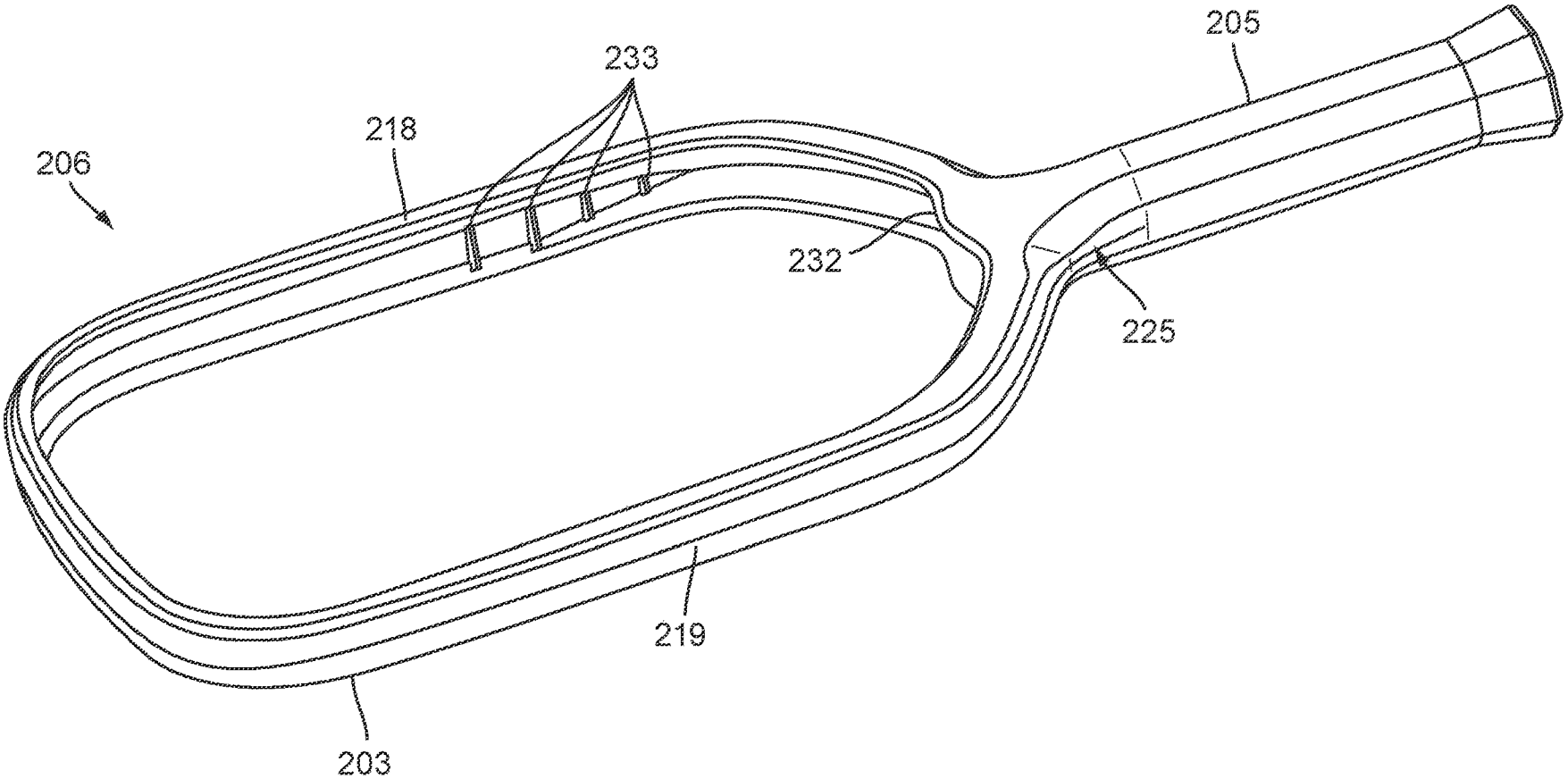
FIG. 18 illustrates an isometric view of a pickleball paddle frame of FIG. 10.

In some embodiments, the first frame member 218 and the second frame member 219 can be coupled by epoxy. Referring to FIGS. 17 and 19, the epoxy can be applied to the bonding surface 229, the lateral bonding surface 230, a top region of each rib, a top region of the retaining structure, and a top region of the paddle periphery surrounding the entirety of the frame. The first frame member 218 and/or the second frame member 219 can receive epoxy. In some embodiments, the second frame member 219 receives epoxy on the bonding surface 229, the lateral bonding surface 230, a top region of each rib, a top region of the retaining structure, and a top region of the paddle periphery, while the first frame member 218 only receives epoxy on the bonding surface 229 and the lateral bonding surface 230. In these embodiments, all the epoxy bonding the first frame member 218 and the second frame member 219 is applied to only one frame member, while epoxy bonding the first frame member 218 and the second frame member 219 to the paddle head subassembly 201 is applied to both frame members.

Once epoxy is applied, the second frame member 219 can be set down, with its interior surface facing up. The paddle head subassembly 201 can be set into its predefined space on the second frame member 219. The reinforcing structures and additional ribs can be used to assist in alignment of the head subassembly 201, and can prevent incorrect assembly. Next, the first frame member 218 can be carefully aligned with the second frame member 219 and placed atop the second frame member 219 and the paddle head subassembly 201. Clamps can be applied to the paddle 200 to press the first frame member 218, the paddle head subassembly 201, and the second frame member 219 together as the epoxy cures. After a pre-determined amount of time, dictated by the epoxy cure time, the paddle 200 can be removed from the clamps and any leftover epoxy can be removed.

As discussed above, the frame can comprise internal cavity structures and additional geometries which help guide and retain the epoxy in desirable locations. The reinforcing structures 241 described above can assist in retaining the epoxy upon the bonding surface plates (102, 202) and prevent it from spreading to other areas of the internal cavity 240, thereby reducing weight from excess epoxy and improving bonding. The outer rim wall 256 of each frame member can further comprise an epoxy retention lip 228 that protrudes from the outer rim edge, in a direction toward the adjacent frame member. The epoxy retention lip 228 can contact the face plates (102, 202) and prevent epoxy from spreading to the visible surface plates (102, 202) of the face plates (102, 202).

B. Mechanical Fasteners

In some embodiments, separate mechanical fasteners 209 can be attached to the frame to assist in attachment. In some examples, these mechanical fasteners 209 can be in the form of clips, clamps, tape, screws, pins, or another fastener. Clips and clamps can be applied to the outside of the frame, following coupling of the first frame member 218 and the second frame member 219. In many embodiments, the clips or clamps would be used after another coupling method is used to initially couple the frame members, and would provide additional security to prevent decoupling. Tape can be applied externally such that it extends across the coupling plane, contacting both the first frame member 218 and the second frame member 219. In some embodiments, the tape can comprise a single elongated piece that extends around at least the entire rim 203 to cover the coupling plane and provide additional security to prevent decoupling, to be used in conjunction with another bonding or coupling method. In other embodiments, the tape can comprise a plurality of separate strips attached at predetermined locations around the rim 203. In some embodiments, fasteners 209 such as screws or pins can be positioned at multiple locations around the frame. The fasteners 209 can extend through apertures in the frame, contacting both the first frame member 218 and the second frame member 219, and/or contacting the paddle head subassembly 201. Any of the mechanical components can also function to provide targeted weighting to the paddle periphery, as well as additional protection from damage.

C. Internal Cavity Retaining Structures

In some embodiments, the frame 206 can further comprise internal cavity structures 241 that contribute to the security of the coupling of the first frame member 218 and the second frame member 219. These internal cavity structures 241 can comprise integral protrusions, integral protrusions and accompanying receiving structures, epoxy anchors, and/or integral protrusions that prevent sliding or decoupling. In some embodiments, integral protrusions can extend from one frame member, across the coupling plane, to contact the adjacent frame member. The protrusions can increase bonding surface area and prevent lateral movement of the frame members (218, 219) relative to one another. In some embodiments, only one frame member (218, 219) comprises protrusions. In these embodiments, the protrusions can be removed from one frame member (218, 219) following molding. In other embodiments, both frame members (218, 219) can comprise protrusions.

In some embodiments, the integral protrusions and receiving structures can be injection molded or co-molded with the first frame member 218 and the second frame member. Protrusions on one frame member can interact with corresponding receiving structures on another frame member to provide additional security. The protrusions and receiving structures can interact by increasing bonding surface area, acting as a wall that blocks lateral movement, and/or increasing friction between the frame members (218, 219) by a press-fit geometry or by pressing against one another. These structures can be positioned within a single mold to interact with each other when two frame members (218, 219) are coupled. In some embodiments, the protrusion(s) and receiving structure(s) can interact as tongue and groove couplers.

The use of identical frame members (218, 219) results in symmetry across the coupling plane. In some embodiments, each frame member also comprises symmetry across a longitudinal plane, perpendicular to the coupling plane. In other embodiments, structures can be formed on opposite sides of the longitudinal plane to interact with one another when the first frame member 218 and the second frame member are coupled. In these embodiments, when the first frame member 218 and second frame member are coupled, they will be mirror images of one another. Complementary structures 241 can be formed within the internal cavity 240 at locations that are evenly positioned across the longitudinal plane. These structures 241 should be positioned upon a single plane, at an equal distance from the longitudinal plane. The plane upon which they are positioned extends perpendicular to the longitudinal plane.

In some embodiments, the frame 206 can further comprise integral locking features that guide the formation of epoxy anchors. The integral locking features can be shaped as loops or hooks that become surrounded by epoxy. The epoxy acts as a bridge that is adhered to both the first frame member 218 and the second frame member 219, and the hooks or loops work with the epoxy to prevent the frame members (218, 219) from moving away from one another.

D. Internal Anchoring Components

In some embodiments, the paddle 200 can comprise internal anchoring components in the form of separate internal components or fills that aid in coupling security. These internal anchoring components can extend across multiple regions of the paddle to contact several parts. For example, a component or fill can be inserted into the handle and extend beyond the handle and into the paddle head subassembly 201.

In some embodiments, the internal anchoring component can be a solid rod that is positioned along the longitudinal plane, within a portion of the handle, and within a portion of the paddle head subassembly 201. In some of these embodiments, the rod can be between 4 inches and 10 inches long. The rod can comprise a depth that equals the distance between the first frame member 218 and the second frame member in the cavity defined by the handle, measured along the longitudinal plane. The rod can contact or nearly contact both the first frame member 218 and the second frame member when installed. In these embodiments, a slit can be defined in the core (104, 204), extending entirely through the core along the longitudinal plane. The slit can be positioned to connect with the bottom edge of the core (104, 204), and can extend along the longitudinal plane a distance of 2-5 inches. The rod can be received by the slit, and can be held in place by friction. The rod can be formed of a rigid or semi-rigid material such as: nylon, carbon, thermoplastic, metal, wood, or plastic.

In other embodiments, the internal anchoring component can be a fill material that fills some or all of the cavity defined by the handle, and extends beyond the handle 205 to contact the core. The fill material can be expandable foam or an elastomeric material. The fill material can further position additional weight in the handle 205, causing the CG to move toward the end cap 217. The fill material can also damp sound and vibrations.

B. Single Rim Embodiment

Figure 4:
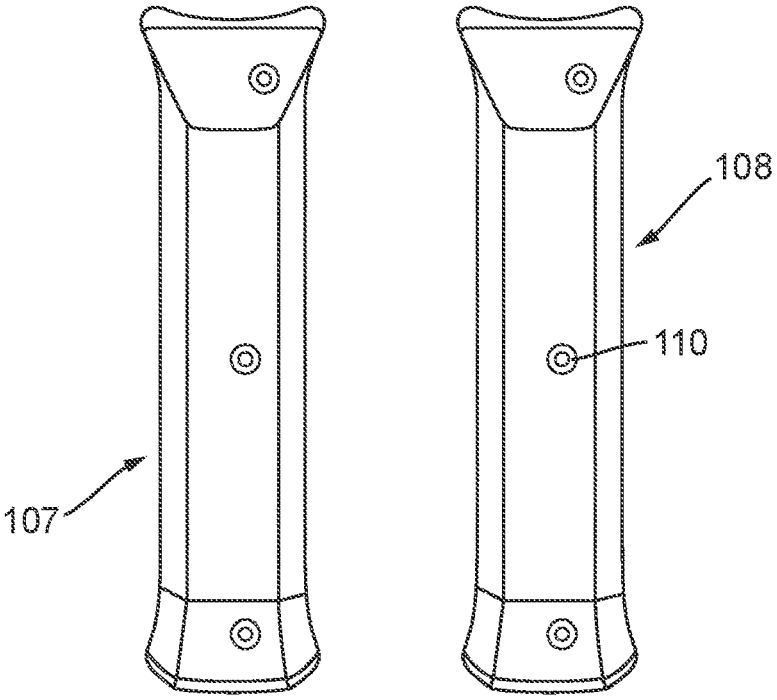
FIG. 4 illustrates an exploded perspective view of the exterior surfaces of a first handle member a second handle member of the pickleball paddle of FIGS. 2 and 3.
Figure 5:
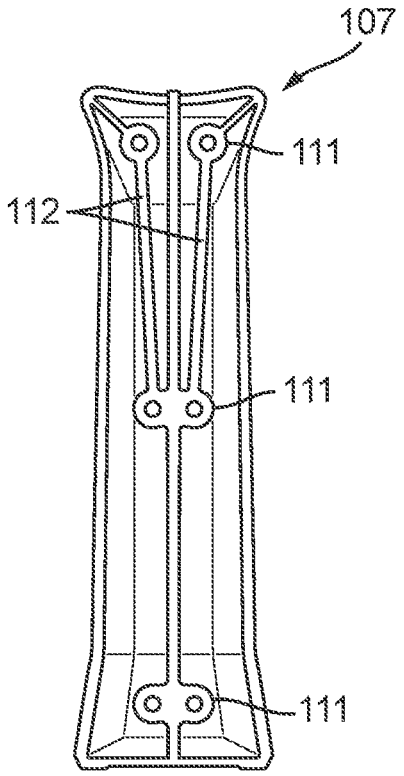
FIG. 5 illustrates an enlarged view of the interior of the first handle member illustrated in FIG. 4.

One embodiment of a structural frame is illustrated in FIGS. 1-5, in which a unitary rim 103 is coupled to a single or multi-component handle. Multi-component handles can be manufactured with one or more identical pieces to reduce the need for additional tooling and increase ease of assembly. The handle 105 can comprise a first handle member 107 and a second handle member 108, as best shown in FIGS. 4 and 5. As shown in FIGS. 4 and 5, the first handle member 107 and the second handle member 108 can be identical pieces with complementary mating geometry including fastener bores 110. The first handle member 107 and the second handle member 108 can cooperate to define a slot. The throat can include a throat flange 222, similar to that shown in FIG. 9. The slot of the handle 105 can be configured to receive the throat flange 222. The throat flange 222 can be secured to the handle 105 by mechanical fastener(s) and/or adhesive(s), or it can be secured by adhesive, press-fit, or another means.

In another embodiment, the rim 103 can comprise a handle support that extends partially or entirely through the handle. The handle support can be integrally formed with the rim 103 and can provide strength that assists in stress distribution to prevent stress accumulation in the handle-rim 103 joint. One or both of the rim 103 and the handle can be injection molded or cast. They can be formed from an injection moldable plastic or composite, or can be a cast metal, such as titanium or aluminum, to provide additional strength. Because the rim 103 only surrounds the paddle head subassembly 101 periphery, it comprises a relatively small amount of material, allowing a heavier material to be used to increase strength, stiffness, and perimeter weighting, while maintaining a low total mass.

Figure 8:
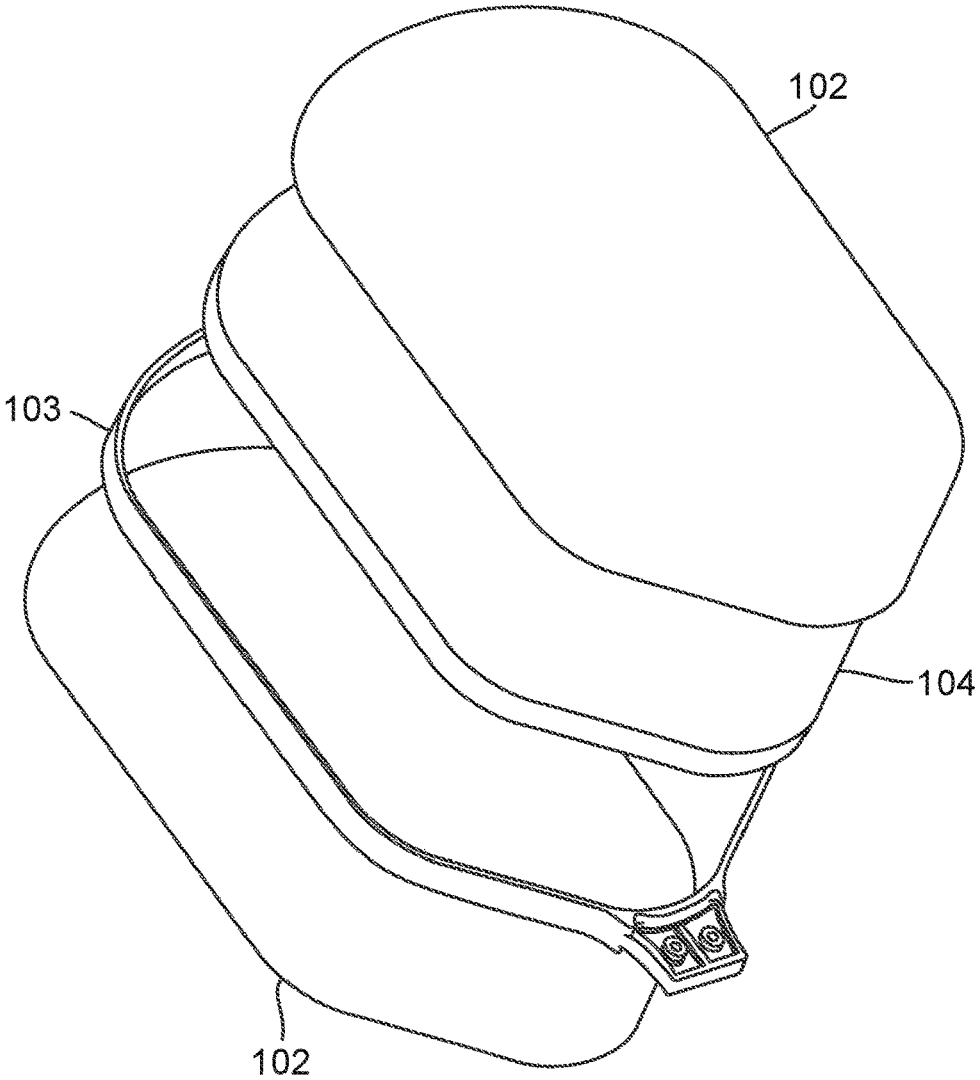
FIG. 8 illustrates an exploded view of the rim and head subassembly of the pickleball paddle of FIG. 1.

Referring to FIGS. 7 and 8, the core and the face plates 102 can be shaped to join with the loop formed by the rim 103. The core is sized to be small enough to fit within the rim 103 and fill the entire space within the rim 103. In many embodiments, the face plates 102 are larger than the core, and they do not fit within the rim 103. Instead, in these embodiments, the face plates 102 extend beyond the core periphery and cover the edge of the rim 103. The edges of the face plates 102 can form the periphery of the rim 103, and lay flush with the periphery of the rim 103. In these embodiments, the rim 103 does not make up any part of the hitting surface, nor does it surround the hitting surface. In these embodiments, the core 104 can comprise a depth that matches the depth of the rim 103 to create an even surface across the core and the rim 103, when joined. In some embodiments, the core can comprise a depth that is slightly less than the depth of the rim 103, leaving room for a backing layer, damping layer, filler, or adhesive to be positioned between the core and the face plates 102, while allowing the face plates 102 to sit directly on the rim 103.

The multi-component paddles (100, 200) can comprise additional features that can alter the feel, sound, and playability of the paddle. These features can include: throat chamfers, a grip, a variable rigidity core, multi-material hitting surface plates, and various material properties, as described in detail below.

III. Grip a. Throat Chamfers

Most shots are played with a single-hand grip, however, for certain shots it is preferable to grip the paddle (100, 200) with two hands. Therefore, it is desirable to create a paddle (100, 200) which provides an ergonomic grip for both two-handed and single-handed shots. One solution is to increase the handle length to provide ample room for two-handed shots. However, tradeoffs must be considered. Since modern paddles (100, 200) are typically constructed at or near maximum length restrictions lengthening the handle means that the frame must be made shorter. This solution is not ideal as decreasing frame length generally reduces perimeter weighting about the paddle (100, 200) Y-axis, thereby decreasing the paddle's (100, 200) sweet spot size. One alternative solution to lengthening grip size is to increase "effective grip length" by designing the throat (116, 216) to be a more ergonomic area which can be used for two-handed shots. Designing the throat (116, 216) to be more ergonomic can be accomplished without requiring a lengthened grip, effectively mitigating any reduction in sweet spot size associated with a lengthened grip.

Figure 13:
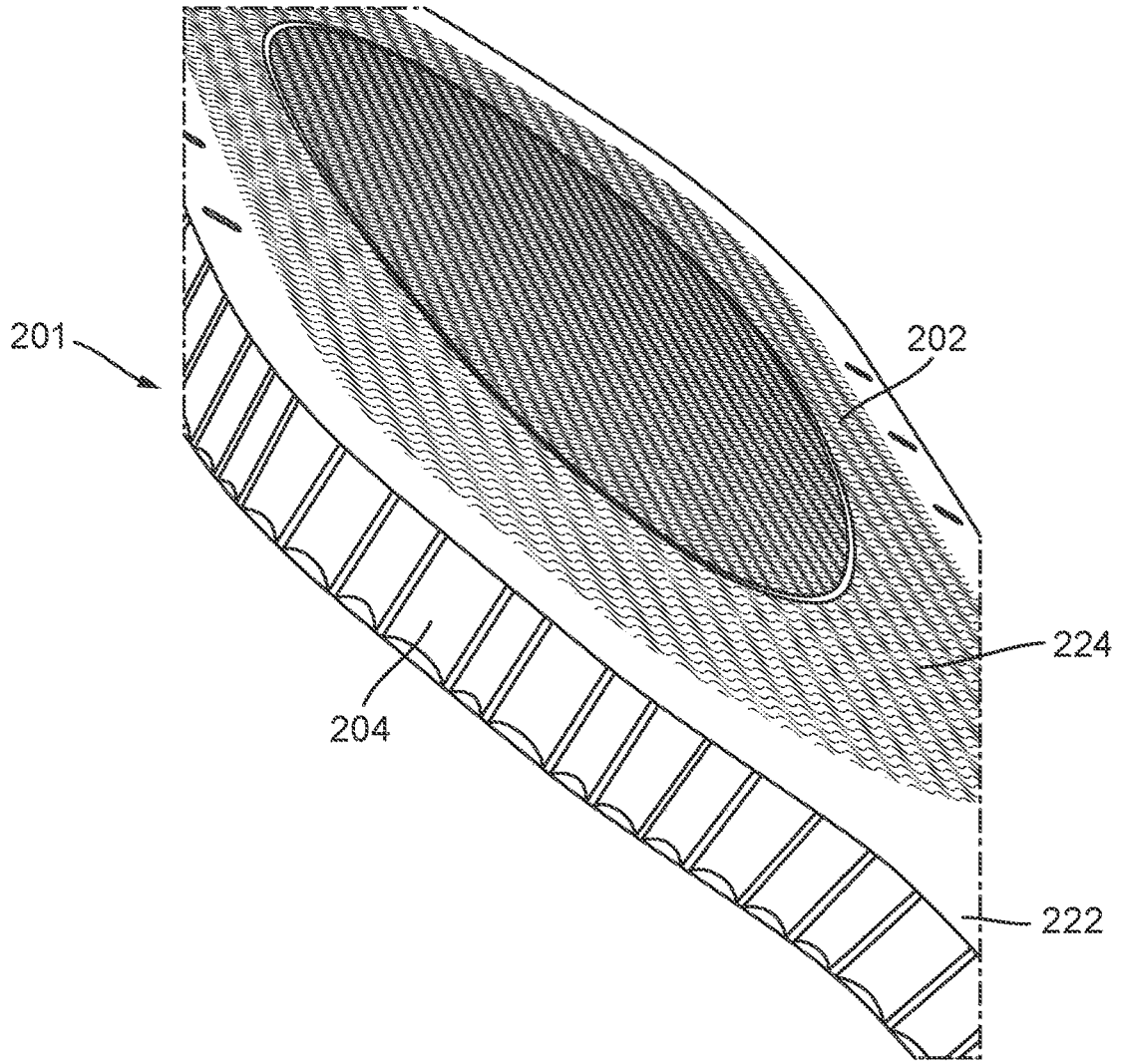
FIG. 13 illustrates a partial isometric view of the head subassembly of the pickleball paddle of FIG. 12.
Figure 14:
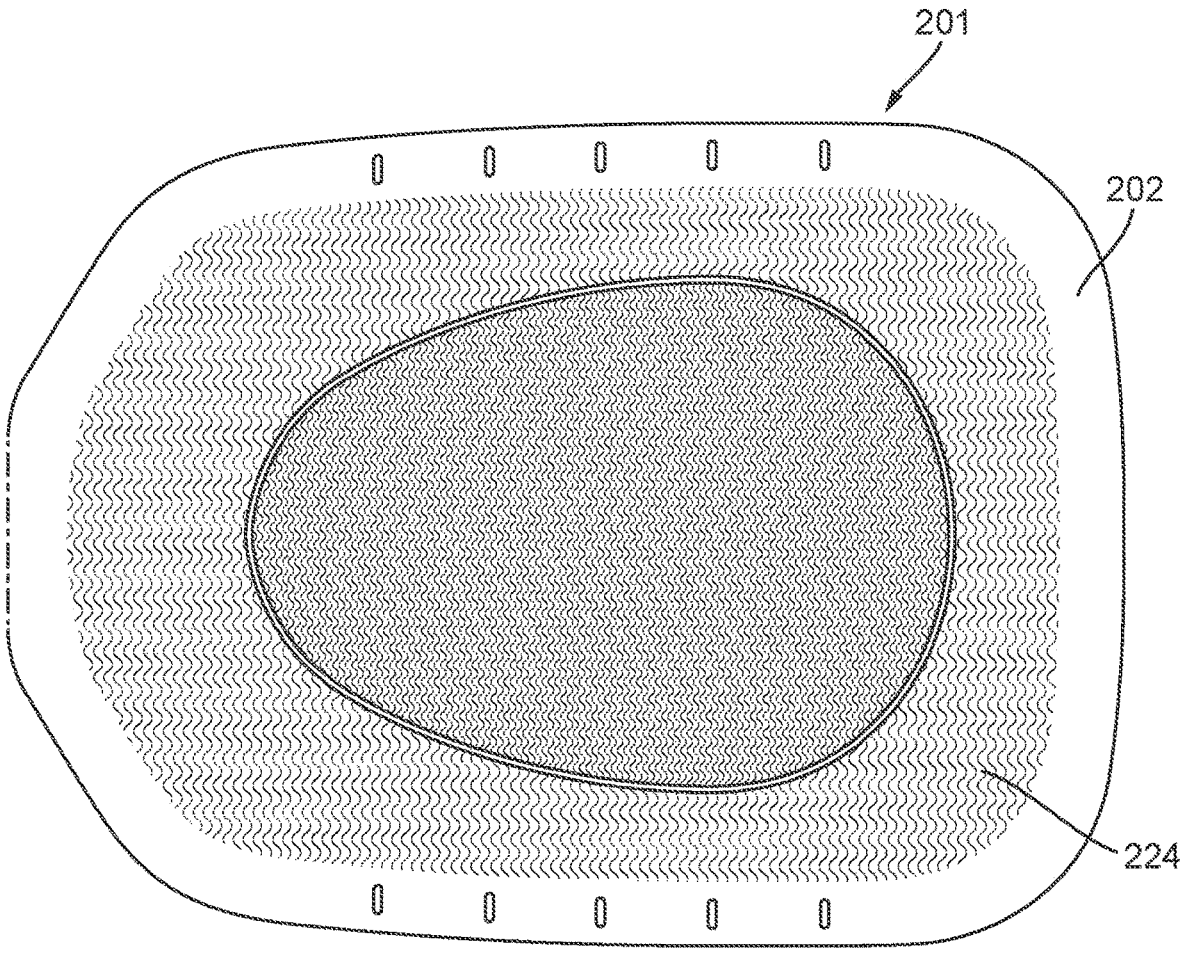
FIG. 14 illustrates a front view of the head subassembly of the pickleball paddle of FIG. 12.

As shown in FIG. 13, the paddle (100, 200) can comprise throat chamfers 225 that form grip regions with improved ergonomic fit and comfort to a user. The throat chamfers 225 can be defined in the throat (116, 216) of the frame. In other embodiments throat chamfers 225 can extend from the grip into the rim (103, 203). Increasing effective grip length by including throat chamfers 225 can improve comfort on two-handed shots without requiring a lengthened handle.

Inclusion of throat chamfers 225 is made possible by the structural frame disclosed herein. As discussed above, without a structural frame, paddles (100, 200) traditionally rely on core material extending into the handle to provide rigidity. Throat chamfers 225 would reduce the amount of core material which can extend into the throat (116, 216) area, thereby reducing the stiffness provided by this core material and compromising the structural integrity of these paddles (100, 200). Therefore, throat chamfers would not be used in paddles (100, 200) which rely on the core material extending into the handle for rigidity.

As discussed above, the throat chamfers 225 of the present disclosure aid in fitting both hands on the paddle (100, 200) handle (or handle members) by providing an ergonomic area where one's thumb and pointer finger of the top hand can rest near the junction of the rim (103, 203) and handle. Throat chamfers 225 make the throat (116, 216) a more ergonomic area by removing sharp edges where fingers rest. Throat chamfers 225 can take on a variety of geometries and sizes.

The throat chamfers 225 of the present disclosure can be made more ergonomic by including transition radii between the throat (116, 216) notches and surrounding geometry. In some embodiments, the boundary of the throat chamfers 225 can include a transition radii which remains constant along the entirety of the throat chamfer 225 boundary. In other embodiments, the boundary surface plates (102, 202) of the throat chamfers 225 can include a varying transition radii along the throat chamfers 225 boundary. In an exemplary embodiment the throat chamfers 225 can have a constant transition radii of 0.063 inches. In other embodiments the throat chamfers 225 radii can be between 0.05 inches to 0.125 inches.

The throat chamfers 225 can each comprise a length measured in-line with the throat (116, 216), from a top-most end of the throat chamfer 225 to a bottom-most end of the throat chamfer. The throat chamfers 225 can each comprise a width measured perpendicular to the throat chamfer length between a point on the throat chamfer 225 nearest the hitting surface and a point on the throat chamfer 225 nearest the coupling plane. The throat chamfer 225 can comprise a length between 0.5 inch and 1.5 inches. The throat chamfer 225 width can vary along its length. The throat chamfer 225 can comprise a maximum width, which is between 0.25 inch and 1.0 inch. The throat chamfer 225 width can vary between 0.05 inch and 1.0 inch along its length. In many embodiments, the chamfered surface smoothly connects with throat (116, 216) geometry. In many embodiments, the throat chamfer 225 can be curved along its length. In some embodiments, the throat chamfer 225 can be curved along its width. In alternate embodiments, throat notches can be defined in the frame that lack the chamfered surface extending away from the chamfer edge nearest the hitting surface. The throat notches are cutouts defined in the frame that provide additional space for the user to grip the handle (105, 205) during two-handed shots.

b. Grip

Figure 12:
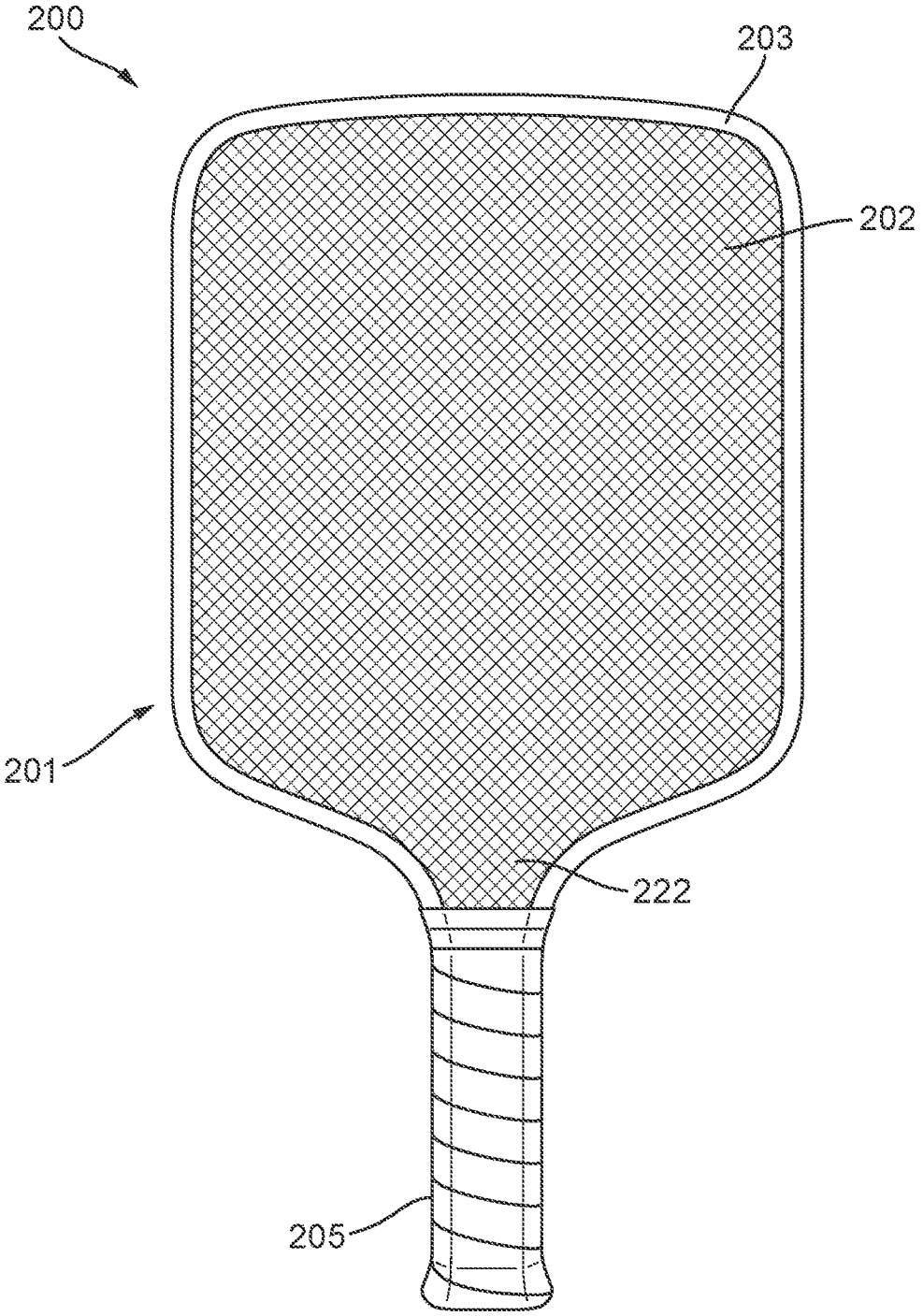
FIG. 12 illustrates pickleball paddling having a metallic face, according to an embodiment of the present disclosure.
Figure 15:
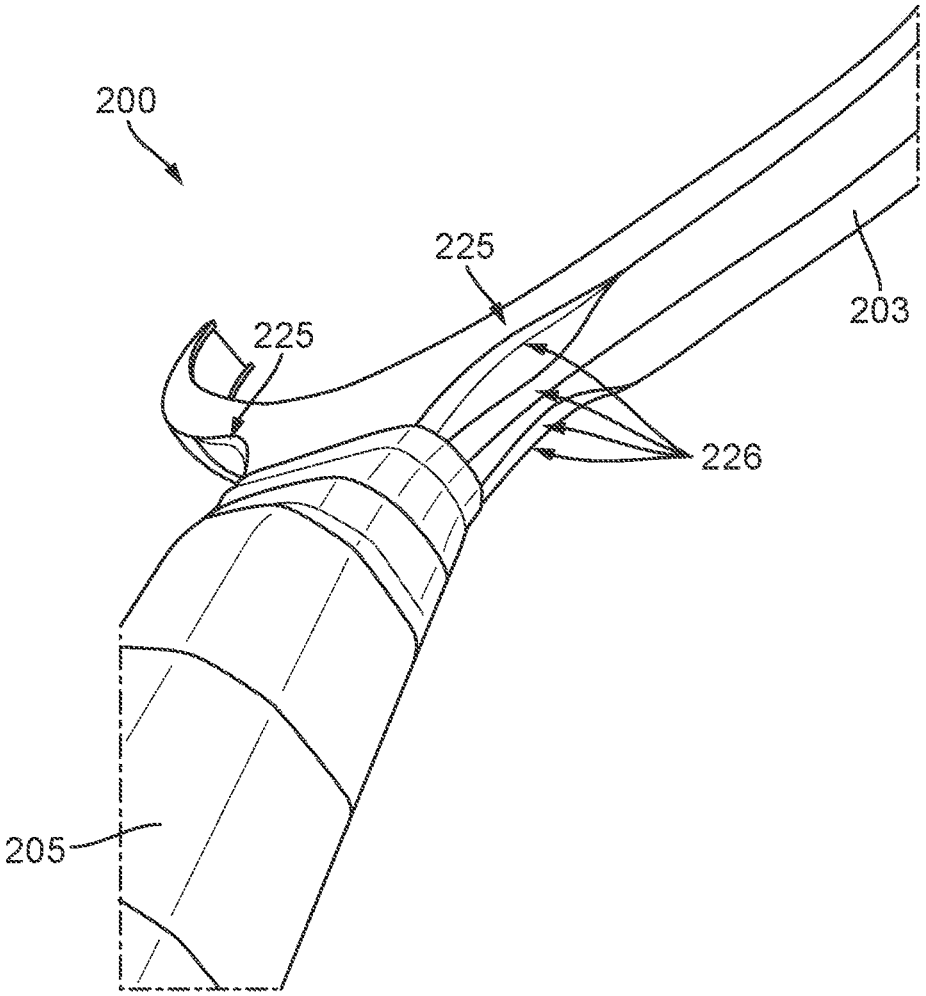
FIG. 15 illustrates a partial perspective view of a pickleball paddle frame according to an embodiment of the present disclosure.
Figure 16:
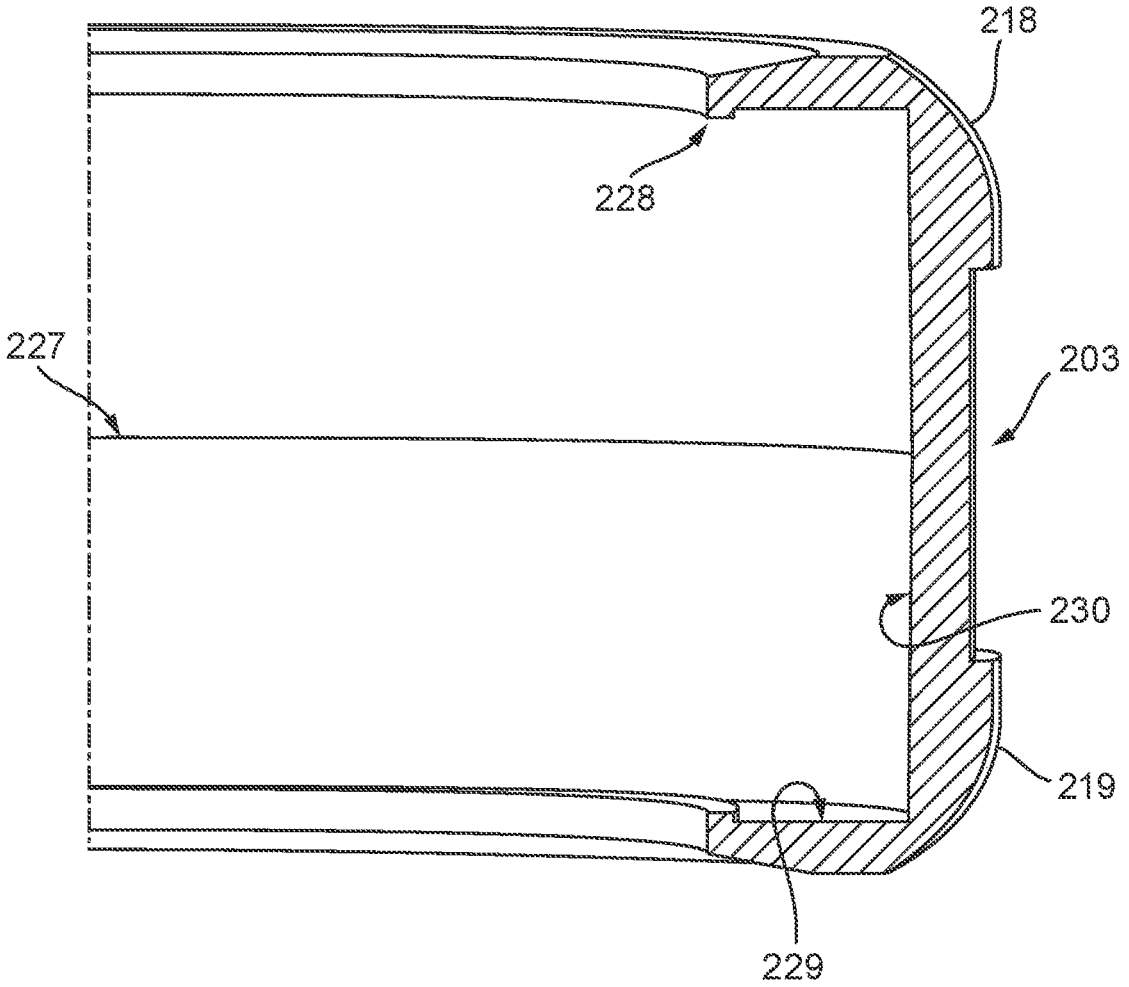
FIG. 16 illustrates an enlarged cross-sectional view of a pickleball paddle frame of FIG. 15

Referring to FIGS. 1, 12, and 15, the multi-component paddle (100, 200, 300) can comprise a grip (138, 238) that encases the handle. In some embodiments, the grip (138, 238) can be a separate member that slides onto, wraps around, or is otherwise coupled to the handle. The grip (138, 238) can alter the feel of the paddle by providing comfort and vibration damping. In some embodiments, the grip (138, 238) can be in the form of a readily available grip tape that can be selected from a large variety of materials, cushion, tackiness, thickness, and textures. The grip tape can be applied by the user and easily removed and replaced. In other embodiments, the grip (138, 238) can be an elastic cover that is pulled over the handle and can be installed and replaced by the user. In other embodiments, the grip (138, 238) can comprise multiple grip members that are separate or partially connected. The grip members can be hinged and latch together, can be press-fit to one another or onto the handle, or can be mechanically fastened to cover the handle (105, 205) and remain in place during use.

IV. Paddle Head Subassembly

As mentioned previously, the paddle (100, 200, 300) can comprise a paddle head subassembly (101, 201). The paddle head subassembly (101, 201) can comprise two face plates (102, 202) and a core. The core can be positioned between the two face plates (102, 202). In many embodiments, the two face plates (102, 202) are identical to one another. An exterior side of each face plates (102, 202) comprises a hitting surface. An interior side of each face plates (102, 202) contacts either the core, a sheet coupled to the core, or a backing layer.

In many embodiments, the core can resemble a honeycomb structure, as shown in FIGS. 8 and 11. The honeycomb structure can comprise a plurality of repeated structures arranged side by side. In some embodiments, the honeycomb structure can comprise polypropylene. In other embodiments, the honeycomb structure can comprise nylon, polymer, or aluminum. The core can comprise a constant thickness or a varying thickness.

a. Variable Rigidity Core

Figure 11A:
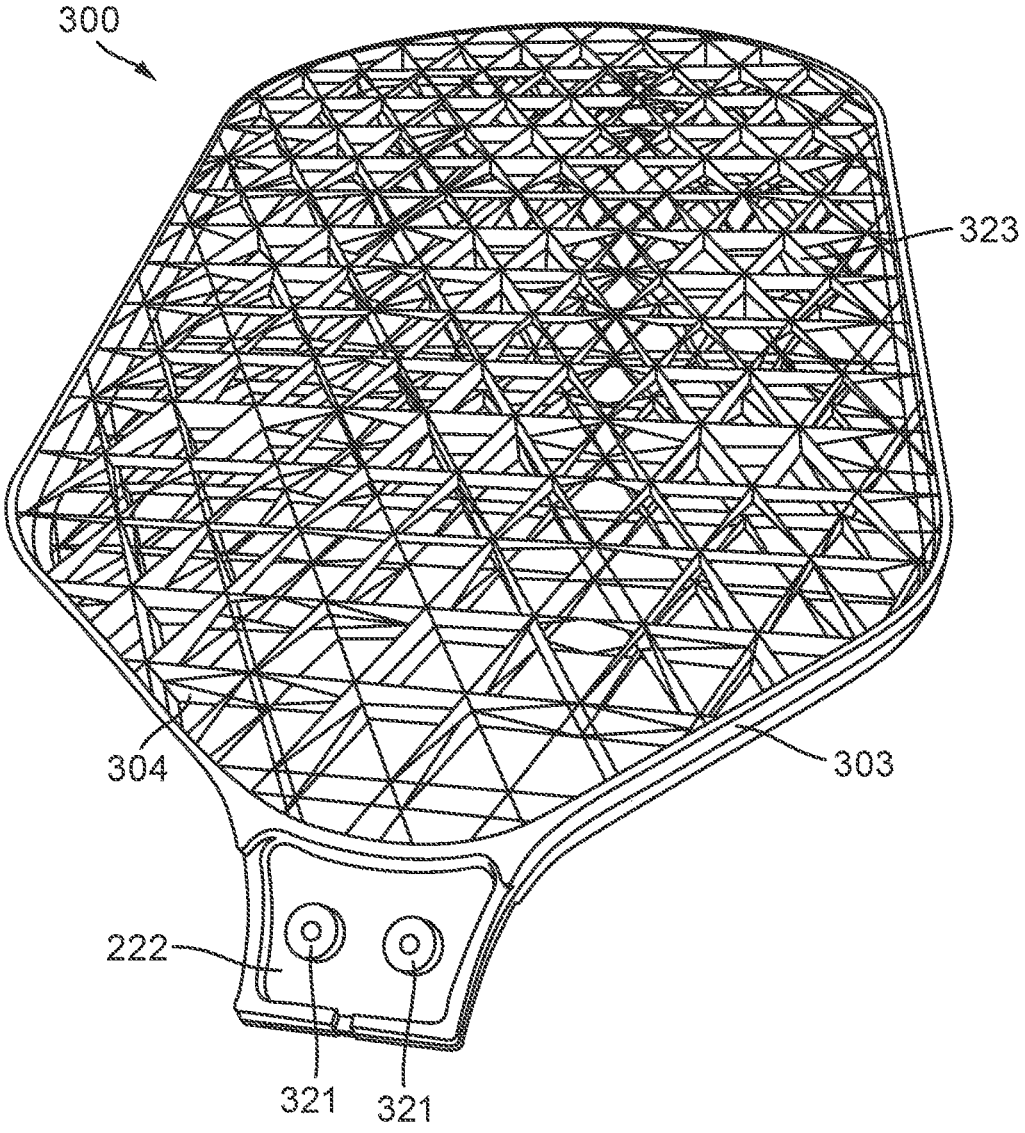
FIG. 11*a* illustrates an integral pickleball paddle core and frame, according to another embodiment.
Figure 11B:
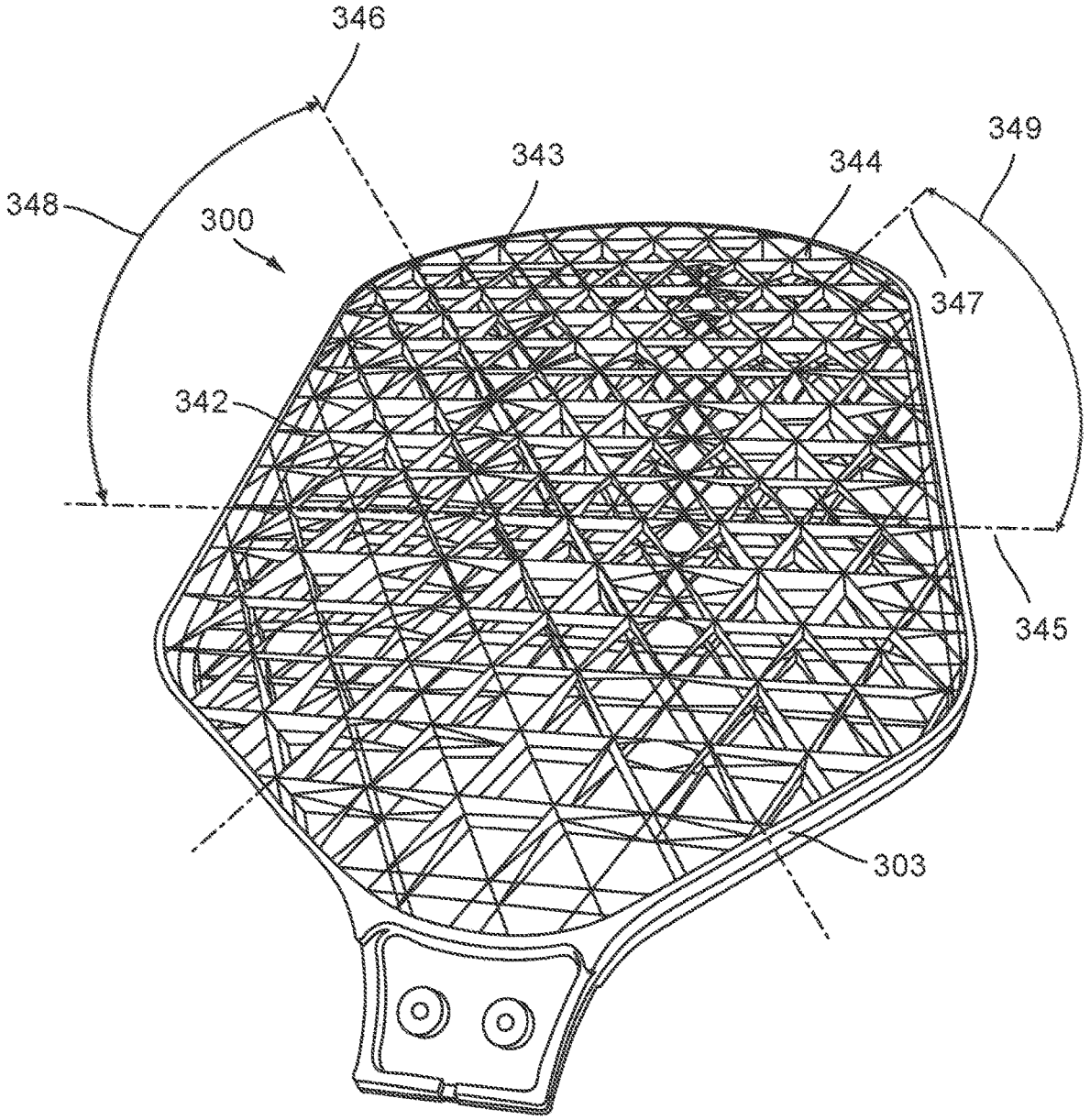
FIG. 11*b* illustrates the integral pickleball paddle core and frame of FIG. 11*a*.

In another embodiment, the core can be formed with the rim (103, 203), as shown in FIGS. 11*a*-11*b* In this embodiment, the core is formed by a plurality of struts. In some embodiments, the struts can be oriented to form a consistent structure in terms of density, weight, and rigidity. In other embodiments, as illustrated in FIGS. 11*a*-11*b*, the struts can comprise variable widths that are designed to create regions of increased strength and rigidity to modify the response of the ball when hit by the paddle. Varying rigidity across the core can create a more consistent hitting surface in terms of power and feel. This can be achieved by deadening targeted regions that typically provide higher energy transfer and, as a result, creating a more consistent hitting surface.

Core rigidity and consistency can be tuned by varying the geometry and quantity of struts. In some embodiments, the internal cavity 240 can comprise primary struts, secondary struts, tertiary struts, and quaternary struts. In other embodiments, the internal cavity 240 can comprise only primary and secondary struts. In one exemplary embodiment, referring to FIG. 11*b*, the internal cavity 240 can comprise primary struts 342, secondary struts 343, and tertiary struts 344. The primary struts 342 can extend from one portion of the paddle rim 303 to another non-adjacent portion of the paddle rim 303. The primary struts 342 can all extend in direction parallel to a first axis 345 such that all primary struts 342 are parallel to each other. The internal cavity 240 can further comprise secondary struts 343 extending from one portion of the paddle rim 303 to another non-adjacent portion of the paddle rim 303 in a second direction 346 different from the first direction 346. The secondary struts 343 can all extend in a second direction parallel to a second axis 346 such that all secondary struts 343 are parallel to each other. A first angle 348 is created by the intersection of the first axis 345 and the second axis 346. Further, the tertiary struts 344 can all extend from one portion of the paddle rim 303 to another non-adjacent portion of the paddle rim 303 in a third direction parallel to a third axis 347, different from the first axis 345 and second axis 346. A second angle 349 is created by the intersection of primary axis 345 and third axis 347. In this manner the primary struts 342, secondary struts 343, and tertiary struts 344 can segment the internal cavity 240 into multiple internal pockets 351. These internal pockets 351 can be filled with material such as damping material. Internal pockets 351 can be selectively filled and left empty to tune/sound and feel across the strike face plates (102, 202). For example, internal pockets 351 centered about the geometric center of the strike face plates (102, 202) can be filled with damping material to improve feel and reduce sound on center strikes.

The quantity and geometry of primary struts, secondary struts, tertiary struts, and/or quaternary struts as well as the first angle, second angle, and third angle, created by these struts drive the impact performance of core. The number of struts further determines the quantity of internal pockets created thereby. Furthermore, the first angle, second angle, and third angle determine the shape of the internal pockets. Therefore, it can be desirous to tune the quantity, geometry of the struts as well as the first, second, and third angles.

In some embodiments, the first angle can be between 10 degrees to 130 degrees. In some embodiments, the first angle can be between 10 degrees to 20 degrees, 20 degrees to 30 degrees, 30 degrees to 40 degrees, 40 degrees to 50 degrees, 50 degrees to 60 degrees, 60 degrees to 70 degrees, 70 degrees to 80 degrees, 80 degrees to 90 degrees, 90 degrees to 100 degrees, 100 degrees to 110 degrees, 110 degrees to 120 degrees, or 120 degrees to 130 degrees.

In some embodiments, the second angle can be between 80 degrees to 180 degrees. In some embodiments, the second angle can be between 80 degrees to 100 degrees, 100 degrees to 110 degrees, 110 degrees to 120 degrees, 120 degrees to 130 degrees, 130 degrees to 140 degrees, 140 degrees to 150 degrees, 150 degrees to 160 degrees, 160 degrees to 170 degrees, or 170 degrees to 180 degrees.

In some embodiments, a third angle created by the intersection of primary struts and quaternary struts can be between 30 degrees to 150 degrees. In some embodiments, the third angle can be between 30 degrees to 40 degrees, 40 degrees to 50 degrees, 50 degrees to 60 degrees, 60 degrees to 70 degrees, 70 degrees to 80 degrees, 80 degrees to 90 degrees, 90 degrees to 100 degrees, 100 degrees to 110 degrees, 110 degrees to 120 degrees, 120 degrees to 130 degrees, 130 degrees to 140 degrees, 140 degrees to 150 degrees, 150 degrees to 160 degrees, 160 degrees to 170 degrees, or 170 degrees to 180 degrees.

As discussed above, the number of struts determines the number of internal pockets. While increasing the number of internal pockets increases the ability to more finely selectively tune impact performance across the strike face, adding additional struts also utilizes more discretionary mass. In some embodiments the number of struts can be between 1 and 500. In some embodiments the number of struts can be between 1 strut to 25 struts, 25 struts to 50 struts, 50 struts to 75 struts, 75 struts to 100 struts, 100 struts to 125 struts, 125 struts to 150 struts, 150 struts to 175 struts, 175 struts to 200 struts, 225 struts to 250 struts, 250 struts to 275 struts to 300 struts, 300 struts to 325 struts, 325 struts to 350 struts, 350 struts to 375 struts, 375 struts to 400 struts, 400 struts to 425 struts, 425 struts to 450 struts, 450 struts to 475 struts, or 475 struts to 500 struts.

Further, some embodiments can include a sheet positioned between the core and each face plates (102, 202). The sheets can be formed from a material that can be coupled to both of the materials used for the core and the face plates (102, 202) or backing layer. These materials can include plastic or polymer, such as polyester, polyethylene, nylon, or another suitable material. The sheets can increase the surface area of the core which interface plates (102, 202) with the inner surface plates (102, 202) of the face plates (102, 202), thereby improving adhesion. Epoxy or an alternative adhesive can affix the sheet to the face plates (102, 202) and to the core.

In some embodiments, an adhesive layer, such as an epoxy sheet film, can be used to adhere the core to the face plates (102, 202) while also increasing the surface area of the core. The core can be adhered to the face plates (102, 202) using adhesives, tapes, epoxies, mechanical fastener assemblies, and any combination thereof. In other embodiments, the face plates (102, 202) may be clamped to the core by the rim (103, 203), fasteners within the rim (103, 203), or weighting members. Manufacturing and assembly methods are discussed in more detail below.

The core can comprise a core length. The core length is measured from a bottom end to a top end. In some embodiments, the core length can be between 7 inches to 17 inches. In some embodiments, the core length can be between 7 inches to 8 inches, 8 inches to 9 inches, 9 inches to 10 inches, 10 inches to 11 inches, 11 inches to 12 inches, 12 inches to 13 inches, 13 inches to 14 inches, 14 inches to 15 inches, 15 inches to 16 inches, or 16 inches to 17 inches. In one exemplary embodiment, the core length is 11.75 inches.

The core can comprise a core width. The core width is measured from the first lateral region 113 to the second lateral region 115. In some embodiments, the core width can be between 7 inches to 17 inches. In some embodiments, the core width can be between 7 inches to 8 inches, 8 inches to 9 inches, 9 inches to 10 inches, 10 inches to 11 inches, 11 inches to 12 inches, 12 inches to 13 inches, 13 inches to 14 inches, 14 inches to 15 inches, 15 inches to 16 inches, or 16 inches to 17 inches. In one exemplary embodiment, the core width is 7.5 inches.

The core can comprise a core thickness. In some embodiments, the core thickness can be between 0.50 inch and 1.0 inch. In some embodiments the core thickness can be between 0.50 inch to 0.6 inch, 0.6 inch to 0.7 inch, 0.7 inch to 0.8 inch, 0.9 inch to 1.0 inch. In some embodiments, the core thickness can be less than 1.0 inch, less than 0.9 inch, less than 0.8 inch, less than 0.7 inch, or less than 0.6 inch.

V. Hitting Surface

The face plates (102, 202) can comprise a generally rounded-edge rectangular shape with the second lateral region 115 and the first lateral region 113 generally parallel to each other and the throat (116, 216) and the top region 114 being curved. In some embodiments, the entire perimeter can be curved to different radii throughout. In other embodiments, the second lateral region 115 and the first lateral region 113 comprise straight regions, while the remaining perimeter is curved. In further embodiments, the second lateral region 115, first lateral region 113, and top region 114 comprise straight regions while the remaining perimeter is curved.

The face plates (102, 202) can be made metals, polymers (e.g. thermoplastic polyurethane, thermoplastic elastomer), composites, plastics, carbon fiber, Kevlar, or any combination thereof. In some embodiments, the face plates (102, 202) can be made of a metal material such as aluminum, titanium, magnesium, nickel alloy, titanium alloys, aluminum alloy, or any other metal or combination of metals suitable for use in a pickleball paddle face. In some embodiments, as described in detail below, the face plate (102, 202) can comprise multiple layers. These layers can be metals, or a combination of a metal, plastic, carbon fiber, and/or fiberglass. In some of these embodiments, each face plate (102, 202) (102, 202) comprises a backing layer. In many of these embodiments, one of the face plates (102, 202) and the backing layer is metal, while the other is a composite or polymer material. In other embodiments, the face plate (102, 202) (102, 202) materials are chosen from a group consisting of carbon fiber, fiberglass, or graphite.

The face plates (102, 202) can comprise a face plate (102, 202) length. The face plate (102, 202) length is measured from a bottom edge to a top region 114. In many embodiments, the face plate (102, 202) length matches the core length. In other embodiments, the face plate (102, 202) length is smaller than the core length. In some embodiments, the face plate (102, 202) length can be between 7 inches to 17 inches. In some embodiments, the face plate (102, 202) length can be between 7 inches to 8 inches, 8 inches to 9 inches, 9 inches to 10 inches, 10 inches to 11 inches, 11 inches to 12 inches, 12 inches to 13 inches, 13 inches to 14 inches, 14 inches to 15 inches, 15 inches to 16 inches, or 16 inches to 17 inches. In one exemplary embodiment, the face plate (102, 202) length is 11.75 inches.

The face plates (102, 202) can comprise a face plate (102, 202) width. The face plate (102, 202) width is measured from a first lateral region 113 to a second lateral region 115. In many embodiments, the face plate (102, 202) width matches the core length. In other embodiments, the face plate (102, 202) width is smaller than the core width. In some embodiments, the face plate (102, 202) width can be between 7 inches to 17 inches. In some embodiments, the face plate (102, 202) width can be between 7 inches to 8 inches, 8 inches to 9 inches, 9 inches to 10 inches, 10 inches to 11 inches, 11 inches to 12 inches, 12 inches to 13 inches, 13 inches to 14 inches, 14 inches to 15 inches, 15 inches to 16 inches, or 16 inches to 17 inches. In one exemplary embodiment, the face plate (102, 202) width is 7.5 inches.

The face plates (102, 202) can comprise a face plate (102, 202) thickness. In some embodiments, the face plate (102, 202) thickness can be between 0.001 inch and 0.013 inch. In some embodiments the face plate (102, 202) thickness can be between 0.001 inch to 0.003 inch, 0.003 inch to 0.005 inch, 0.005 inch to 0.007 inch, 0.007 inch to 0.009 inch, 0.009 inch to 0.011 inch, 0.011 inch to 0.013 inch. In some exemplary embodiments, metallic face plate (102, 202)s can have a thickness between 0.003 inch and 0.010 inch.

VI. Multi-Material Face Plates (102, 202)

In some embodiments, the paddle (100, 200, 300) can comprise metallic face plates (102, 202). The metallic face plates (102, 202) can define all or some of the hitting surface. In some embodiments, the face plates (102, 202) can comprise multiple layers. Multi-layer face plates (102, 202) can comprise an exterior surface intended for striking the ball and one or more backing layer(s) for reinforce the hitting surface and/or provide damping. Integrating a metallic face plate (102, 202) can improve durability relative to existing carbon fiber and fiberglass face plates (102, 202). Titanium, for example, has a compressive strength between 120 and 170 MPa, and a modulus of elasticity of about 380 MPa. Accordingly, a metallic face plate (102, 202) can be more flexible and durable under repeated loading, such as that introduced by repeatedly hitting a pickleball, than a carbon fiber or fiberglass face.

In some of these embodiments, the exterior layer and the backing layer(s) can be made of different materials. The multi-layer face plate (102, 202) can comprise between one and six backing layers. In some embodiments, the multi-layer face plate (102, 202) can comprise an outer layer formed of thermoplastic, thermoset, carbon-fiber, or composite material and a backing layer formed of a metallic material, such as those listed above. In other embodiments, the multi-layer face can comprise an outer layer formed of a metallic material and a backing layer formed of carbon-fiber or a carbon-fiber composite material. Multi-layer face plates (102, 202) which include carbon-fiber materials can enable the use of a thinner metallic layer vs. a single-layer metallic face plate (102, 202). Thereby, multi-layer metallic face plates (102, 202) can improve face flexibility and enable weight savings. The multi-layer metallic face plates (102, 202) described herein can be used in combination with other techniques disclosed herein such as core materials or structures. In one example, epoxy resin sheets can be used to bond the metallic face plate (102, 202) to the core by an epoxy resin.

In some embodiments, the multi-layer face plate (102, 202) can comprise a metal layer. In one example, the metal layer can be titanium (Ti) or titanium alloy (Ti alloy). In other examples, the metal can be any one or combination of the following metals and their respective alloys: aluminum, magnesium, nickel, or steel. These embodiments can further comprise one or multiple composite backing layers. In some embodiments, the composite can comprise a filler material, as described in detail below.

In some of these embodiments, Ti/Ti alloy or another metal can be positioned externally as the outer layer, such that it makes up the hitting surface. In other embodiments, the carbon fiber reinforcing layer can be positioned externally as the outer layer, such that it makes up the hitting surface. The metal layer can be 0.001 inch to 0.010 inch thick. In some embodiments, the metal layer can be between 0.001 and 0.003 inch, 0.003 and 0.005 inch, 0.005 and 0.007 inch, 0.007 inch and 0.009 inch, or between 0.008 inch and 0.010 inch thick. In one exemplary embodiment, the metal layer is between 0.003 inch and 0.004 inch thick.

In some multi-layer face embodiments, including those with layers of titanium, the carbon fiber reinforcing layer can comprise multiple unidirectional carbon fiber sheets. In some multi-layer face embodiments, the carbon fiber reinforcing layer can comprise two, three, four, five, or six sheets of unidirectional carbon fiber. In an exemplary embodiment, the multi-layer face can comprise three unidirectional carbon fiber sheets.

In some embodiments, the outer layer has a greater surface area than that of the backing layer(s). In many of these embodiments, a perimeter region of the outer layer is devoid of a backing layer. In embodiments including multiple backing layers, the backing layers comprise a first backing layer that abuts the outer layer. Embodiments with one backing layer include only the outer layer and the first backing layer. The first backing layer can be attached to an inner surface of the outer layer with adhesive or by heating and pressing. In other embodiments, the first backing layer is not attached to the outer layer inner surface but is sandwiched between the outer layer and the core or an additional backing layer.

The non-metal material used in the multi-layer face can be any one or combination of the following materials: thermoplastic, thermoset, carbon fiber, or composite. Suitable thermoplastic polymers can include polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), polyamide 11 (PA11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherim (103, 203)ide (PEI), polyvinylidene fluoride (PVDF), polymethylmethacrylate (PMMA), polyether ether ketone (PEEK), polyether ketone (PEK), polyetherim (103, 203)ide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), or alloys of the above described thermoplastic materials, such as an alloy of acrylonitrile butadiene styrene (ABS) and polycarbonate (PC) or an alloy of acrylonitrile butadiene styrene (ABS) and polyamide (PA).

The composite material used in the multi-layer face plate can include reinforcement fillers. The fillers can be: fibers, beads, or other structures comprising various materials that are mixed with the thermoplastic polymer. The fillers can provide structural reinforcement, weighting, lightening, or various other characteristics to the thermoplastic composite material. In many embodiments, the fillers can comprise carbon fibers or glass fibers. However, in other embodiments, the fillers can comprise other suitable materials. For example, the fillers can comprise aramid fibers (e.g. Nomex, Vectran, Kevlar, Twaron), bamboo fibers, natural fibers (e.g. cotton, hemp, flax), metal fibers (e.g. titanium, aluminum), glass beads, tungsten beads, or ceramic fibers (e.g. titanium dioxide, granite, silicon carbide).

In some embodiments, an adhesive layer(s) can be interposed between layers of the multi-layer face. The adhesive layer(s) can comprise a sheet of adhesive material such as an epoxy sheet film. The adhesive layer(s) can be interposed between each layer of the paddle to provide a large bonding surface for each layer of the paddle. In some embodiments, adhesive layer(s) can be used between only certain layers of the paddle. In some embodiments, adhesive layer(s) can be used to bond titanium outer layers of the paddle to backing layers of the paddle. As discussed in detail above, adhesive layers can be particularly advantageous for bonding a honeycomb core material to other layers of the paddle since honeycomb structures used for core materials tend to have limited surface area for bonding.

Figure 9:
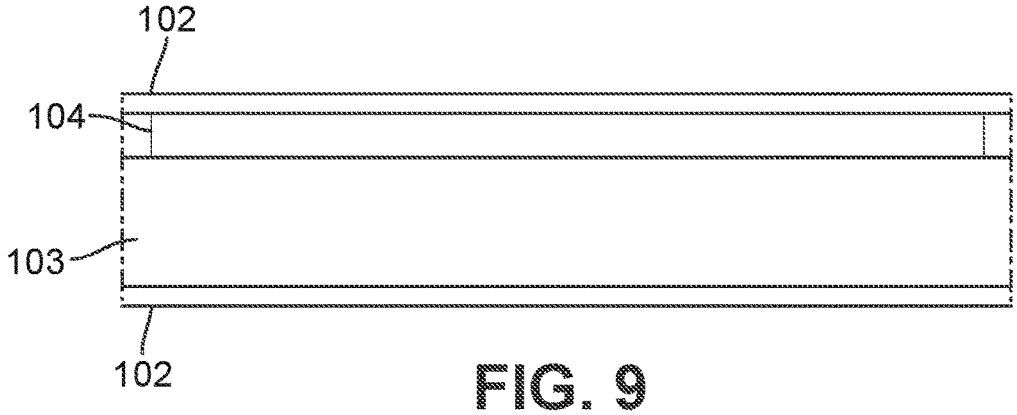
FIG. 9 illustrates an exploded enlarged side view of the rim and head subassembly of FIG. 8.

Additionally, metallic materials are particularly well suited to laser etching treatments. As discussed in detail above, laser etching a face plate (102, 202) facilitates unique exterior finishes that can improve ball spin and improved adhesion to the core. In some embodiments, the metallic face plate (102, 202) can include a textured pattern, as shown in FIGS. 8 and 9. The textured pattern can increase ball spin to alter the trajectory of the ball after contact with the face plate (102, 202). For example, the textured pattern can be biased toward the outer edges of the face plate (102, 202) so that an increased amount of corrective spin is imparted on the pickleball in those regions, reducing variability of outcomes on mishits. Additionally, laser etching can introduce a textured pattern which can increase back spin, yielding improved shorter shots into the "kitchen." This increased back spin can prevent the ball from travelling as far toward the opposing baseline. This can be desirable in many situations, such as when a player is returning a serve and wants to force the opposing player to come forward. In other embodiments, a laser etched textured pattern (detailed below) can be introduced which increases top spin, resulting in shots that "jump" toward the opposing baseline upon contact with the ground.

VII. Paddle

The complete paddle (100, 200) can comprise the frame, the core, and the face plates (102, 202). The complete paddle can comprise a total mass, a center of gravity, a swing weight, a twist weight, a recoil weight, and a spin weight, all of which can be modified by strategically positioning discretionary mass. In many embodiments, total mass of the complete paddle can be between 7 oz and 9.5 oz. In many embodiments, the center of gravity can be located between 9 and 10 inches from the end cap of the paddle.

The total mass of the complete paddle can range from 7.0 oz to 9.5 oz. In some embodiments, the total mass of the complete paddle can be between 7.0 oz and 7.5 oz, 7.5 oz and 8.0 oz, 8.0 oz and 8.5 oz, 8.5 oz and 9.0 oz, or 9.0 oz and 9.5 oz. In some embodiments, the total mass can be greater than 7.0 oz, greater than 7.5 oz, greater than 8.0 oz, greater than 8.5 oz, or greater than 9.0 oz.

In many embodiments, the paddle center of gravity (CG) can be located near a center point of the hitting surface. The CG can be positioned along a longitudinal plane halfway between the first and second lateral regions (113, 115). In some embodiments, the center of gravity can be positioned between 9 and 10 inches above the end cap of the paddle, along the longitudinal plane.

The assembled paddle comprises an assembled paddle thickness. The assembled paddle thickness can be between 0.5 inch and 1.25 inches. In some embodiments, the assembled paddle thickness can be between 0.5 inch and 0.75 inch, 0.75 inch and 1.0 inch, 1.0 inch and 1.25 inches.

VIII. Methods Of Manufacture And Assembly

In some embodiments, the paddle can comprise one or more injection molded components. The one or more injection molded components can make up the handle, the rim (103, 203) and/or the core. The injection molded components can be created out of a molded thermoplastic material. A molded thermoplastic material is one that relies on the polymer itself to provide structure and rigidity to the final component. The molded thermoplastic material is one that is readily adapted to molding techniques where the material is freely flowable when heated to a temperature above the melting point of the polymer. The thermoplastic material can be a filled thermoplastic (FT) material or an unfilled thermoplastic (UT) material. The thermoplastic material should preferably incorporate one or more engineering polymers that have sufficiently high material strengths and/or strength/weight ratio properties to withstand typical pickleball use while still providing weight savings that are beneficial to the present design.

In some embodiments, the paddle (100, 200) can comprise one or more cast components. The one or more cast components can make up the handle and/or the rim (103, 203). The cast components can be formed from a castable metal such as: titanium, aluminum, magnesium, steel, or an alloy thereof. Casting components can allow for selective weighting to be integrally formed with the frame (106, 206).

The various separately-formed parts can be coupled to form the paddle (100, 200). These parts, including some or any combination of the following: the first handle member, the second handle member, the first frame member 218, the second frame member, the end cap, and the head subassembly (101, 201) can be coupled to form the complete paddle (100, 200). These parts can be coupled by any one or combination of the following: mechanical fasteners, adhesives, ultrasonic welding, or any other suitable means for coupling.

Embodiments of the two-component frame design are formed by coupling two identical frame members. The identical frame members (218, 219) can be injection molded in a single mold. Because the frame members (218, 219) are identical, there is no need for the creation of multiple expensive mold designs, thereby greatly reducing costs. Furthermore, the use of two identical frame members (218, 219) reduces assembly error by completely preventing the possibility of incorrect parts being coupled.

Suitable thermoplastic polymers can include polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), polyamide 11 (PA11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherim (103, 203)ide (PEI), polyvinylidene fluoride (PVDF), polymethylmethacrylate (PMMA), polyether ether ketone (PEEK), polyether ketone (PEK), polyetherim (103, 203)ide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), nylon, or alloys of the above described thermoplastic materials, such as an alloy of acrylonitrile butadiene styrene (ABS) and polycarbonate (PC) or an alloy of acrylonitrile butadiene styrene (ABS) and polyamide (PA).

The composite material can include reinforcement fillers. The fillers can be: fibers, beads, or other structures comprising various materials that are mixed with the thermoplastic polymer. The fillers can provide structural reinforcement, weighting, or various other characteristics to the thermoplastic composite material. In many embodiments, the fillers can comprise carbon fibers or glass fibers. However, in other embodiments, the fillers can comprise other suitable materials. For example, the fillers can comprise aramid fibers (e.g. Nomex, Vectran, Kevlar, Twaron), bamboo fibers, natural fibers (e.g. cotton, hemp, flax), metal fibers (e.g. titanium, aluminum), glass beads, tungsten beads, or ceramic fibers (e.g. titanium dioxide, granite, silicon carbide).

The fillers can be combined with the plastics to various percentages by volume. In some examples, the composite material can comprise up to 20% fill by volume. For example, the composite material can comprise 0%-6%, 6%-12%, or 12%-20% fill by volume. The composite material can comprise 0%-2%, 2%-4%, 4%-6%, 6%-8%, 8%-10%, 10%-12%, 12%-14%, 14%-16%, 16%-19%, or 18%-20% fill by volume.

In some embodiments, components such as the handle (105, 205) can be formed using additive manufacturing processes such as 3D printing. Additive manufacture can improve manufacturability of more complex geometries, and can allow manufacturers to offer custom, player specific, solutions. In some embodiments, a handle (105, 205) can be 3D printed based on a custom mold of a player's hand or grip. The 3D printed handle (105, 205) can engage a portion of, for example, a two-component frame. Additionally, a 3D printed or injection molded handle (105, 205) can include a recess in the lower portion of the handle (105, 205). The recess can be filled with foam, polymer, plastic, rubber, or any other material suitable to alter weight distribution or feel. For example, the foam fill can cushion the grip, reducing pressure experienced by the player's hands and thereby mitigating fatigue and the risk of injury.

Creating the frame (106, 206) by injection molding or additive manufacturing enables formation of complex geometries without incurring high manufacturing costs. Thereby, injection molded embodiments of the present disclosure can comprise features such as recesses, chamfers, or multi-radii curvatures without incurring high costs. Alternatively, these features can also be formed using other manufacturing methods such as casting, additive manufacturing, subtractive manufacturing, or the like.

IX. Face Plates Texturing

Further, the metallic face plate (102, 202) can include a textured interface engaging the core (104, 204). This textured interface can comprise an increased roughness relative to a carbon fiber or fiberglass sheet. Accordingly, the bonding material (e.g., epoxy) between the core (104, 204) and metallic sheet can more effectively adhere the metallic sheet to the core (104, 204). Improved adhesion between the core (104, 204) and face can improve durability. Namely, increased roughness on the inner surface of the face plates (102, 202) can make the face less likely to detach from the core (104, 204).

The interior surface plates (102, 202) of the face plates (102, 202) can comprise bonding features such as grooves or raised embossing to aid in even and controlled adhesive distribution. In some embodiments these bonding features can be laser or chemically etched into the face plates (102, 202) interior surface plates (102, 202). Etching of the face plates (102, 202) interior surface plates (102, 202) can be particularly advantageous as it allows for a high level of control over surface roughness. Some examples of these bonding features made by laser etching can be seen on the exterior surface plates (102, 202) of the face plates (102, 202) in FIGS. 10-12. The bonding features can aid in flow and distribution of epoxy across the surface, while also increasing bonding surface area, thereby improving strength of the bond. Texturing may be achieved by treatments such as: laser etching, chemical etching, sand blasting, electroplating, textured paint application, milling, abrasive application, or grinding.

Figure 10:
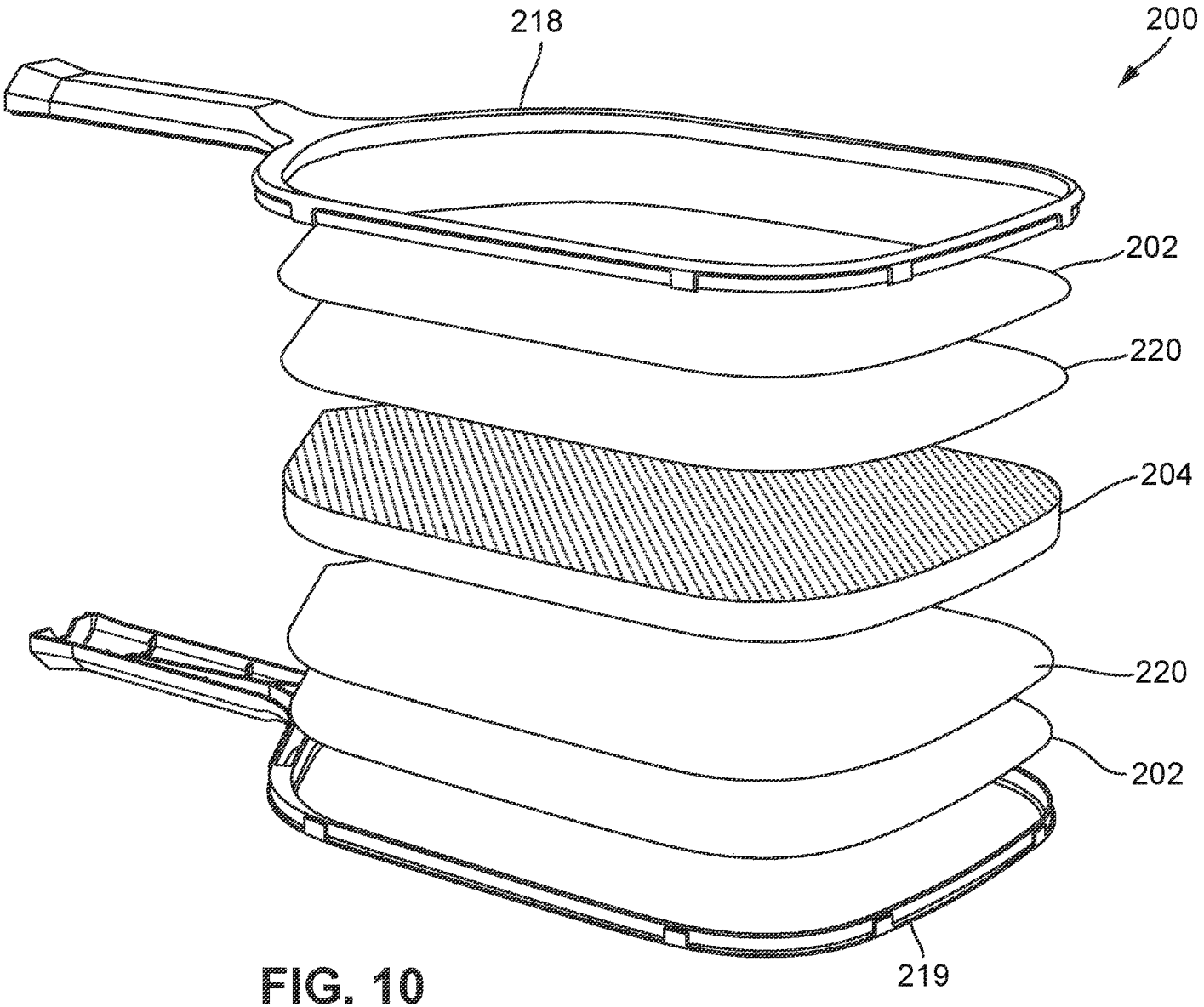
FIG. 10 illustrates an exploded view of a pickleball paddle according to another embodiment.

Referring to FIGS. 10-12, in addition to creating bonding features, surface texturing can be used on the exterior surface of the face plates (102, 202). Surface roughness of the hitting surface can be increased through texturing, increasing friction and, as a result, spin imparted to a pickleball with certain hitting techniques. In some embodiments, etching can be selectively applied to regions on the face that, when impacted, typically result in lower spin to achieve a uniform spin distribution across the striking surface of the paddle.

In other embodiments, texturing can be selectively applied to the face plate (102, 202) to heat treat areas of the hitting surface. Selective heat treatment of the face plate (102, 202) can alter its material properties (such as hardness) in targeted regions and can also be used to apply cosmetic designs to the face plate (102, 202) which may be used to clearly indicate a sweet spot or face center.

Examples

Example 1

A first exemplary injection molded thermoplastic paddle was formed both from premium engineered plastic and less expensive, commodity plastic and compared to a prior art composite paddle. This exemplary has several advantages over prior art paddles formed through thermoset composite compression molding. Advantages include total material cost, processing cost, transportation costs, inventory costs, reduced tooling costs, increased tooling life, consistency of quality improvements, design detail flexibility, surface finish improvements, and the ability to separately manufacture the frame and the panel.

The first exemplary paddle material cost is significantly less than that of the prior art composite paddle. The cost for the carbon fiber and epoxy needed to form the prior art paddle is in a range of $30.00 to $40.00. In contrast, when using premium-engineered, fiber-filled composite plastic, the material cost for the first exemplary paddle is in a range of $2.50 to $5.00 per paddle. Using lower strength, less expensive plastics can reduce the paddle material cost to a range of $0.50 to $2.00 per paddle. Further, any trim material from the carbon composite paddle is simply lost. Trim material from the plastic injection molded paddle can be reground and reclaimed for use. This recycling may further reduce the total material cost of the first exemplary paddle.

The first exemplary paddle processing cost is significantly lower than the prior art composite paddle. The prior art composite paddle is formed using a multiple layer, pre-preg layup method, typically requiring at least 10 minutes of layup time and 15 minutes of cure time. Further, the prior art composite paddle is a single piece construction, forming the paddle faceplate and handle as a single piece. In contrast, the first exemplary paddle frame injection molding time is 1 minute to 2 minutes, and allows for repeated injection cycles without manual intervention. This contrast in manufacturing cycle time, in turn, also significantly reduces the tooling costs for a given production volume. The manual pre-preg layup method requiring 25 minutes of processing time would require 12 to 25 times the number of molds to equal the output of a single injection mold. Furthermore, the 10 minutes of layup time required by that method is not needed in the production of the first exemplary paddle. Fewer molds needed for a given production volume reduces the total molds cost for that production volume, and faster cycle times with the lower labor cost reduces the first example total cost. The first exemplary paddle's lower manufacturing cycle time and labor costs provide another advantage. The needed component production volume is able to be produced locally to the assembly operation on demand. This allows a faster response to demand fluctuations, eliminates the transportation cost of finished inventory from a sub-contractor to the order fulfillment site, and reduces the amount of finished goods inventory.

The first exemplary paddle frame and core are manufactured by plastic injection molding. This manufacturing process is capable of producing smaller features. Features as small as 0.005 inch in any dimension can be produced. This allows greater design freedom than the prior art composite layup that can only support features almost two orders of magnitude larger. The first exemplary paddle's smaller feature size provides the more complex features discussed above, such as adhesive channels, ribs, snap fit features, and weight insertion locations. Furthermore, surface finish is at its final state without post molding finishing operations, saving still more labor costs while providing a more consistent product. The first exemplary paddle design also provides precise control over important dimensional variables such as wall thickness and mass. These, in turn, provide a consistent hitting response for the user.

Example 2

A second exemplary paddle frame was made from 12% carbon fiber filled/PA and a 6-layer carbon fiber face having a core bonded between two frame halves. A prior art paddle was constructed using the industry standard method. The prior art paddle was formed from a carbon fiber layup over a core wherein the paddle face and the paddle handle were a single piece. The prior art paddle did not have a frame, rather, it had a non-structural, soft edge tape adhesively attached to the paddle perimeter. The stiffness of each paddle was measured using an industry standard test. The paddles were each clamped at the handle, leaving the face suspended, cantilevered parallel to a table surface. A force probe was pushed against the paddle face at the standard measurement location approximating the standard striking point or face center. During the test, as the force probe is pushed against the paddle face, the paddle deflects downward toward the table surface. The vertical deflection distance was measured vs. the force applied. The stiffer the paddle, the larger force is necessary for any given deflection distance.

Testing the stiffness of the second exemplary paddle and the prior art paddle showed a large difference in stiffness. The second exemplary paddle had a measured stiffness of 50.9 lbf/inch. The prior art paddle had a measured stiffness of 38.2 lbf/inch. The construction technique of the second exemplary paddle, having a paddle head subassembly joined to a structural frame allows the frame to bear the flexural load. In contrast, the prior art paddle relies on the single piece faceplate/handle to bear the flexural load. The prior art paddle construction technique forces the paddle designer to tradeoff paddle stiffness with face response. For the standard paddle, softening the faceplate requires a reduction of stiffness. In the second exemplary paddle, the paddle stiffness is largely engineered into the separate frame, allowing the faceplate characteristics to be independently engineered.

Example 3

A third exemplary paddle frame was made from polycarbonate and completed with a 6-layer carbon fiber face having a core bonded between two frame. The third exemplary paddle had a stiffness of 28.8 lbf/inch when tested according to the procedure outlined in Example 2. The third exemplary paddle had the same paddle head subassembly as the second exemplary paddle. The difference in stiffness between the second exemplary paddle and the third exemplary paddle is entirely accounted for by the difference in frame material, as these two paddles were formed in the same mold. This example illustrates the ability for paddles constructed according to the present invention to isolate the paddle stiffness from paddle head subbasembly design, thereby enabling paddle head subassemblies to be constructed for performance characteristics.

Clauses

Clause 1. A method of assembling a pickleball paddle having paddle head subassembly, the method comprising: injection molding a first frame member having a first rim member extending from and integral with a first handle member; injection molding a second frame member having a second rim member extending from and integral with a second handle member; positioning the paddle head subassembly between the first frame member and the second frame member; coupling the first frame member to the second frame member with the paddle head subassembly secured therebetween; wherein the paddle head subassembly is joined to the first rim member and the second rim member; wherein the paddle head subassembly is located within, and a perimeter portion of the paddle head subassembly is surrounded by, the first rim member and the second rim member such that majorities of a first face plate and a second face plate of the paddle head subassembly are exposed; and wherein paddle head subassembly is not located within nor surrounded by the first handle member and the second handle member.

Clause 2. The method of clause 1, wherein the first frame member and the second frame member are joined using adhesives.

Clause 3. The method of clause 1, wherein the paddle head subassembly, the first frame member and the second frame member are secured via a method selected from one or more of the following: mechanical fasteners, adhesives, and ultrasonic welding.

Clause 4. The method of clause 3, wherein coupling the first frame member and the second frame member comprises mechanically coupling the first frame member to the second frame member.

Clause 5. The method of clause 1, wherein the core resembles a honeycomb structure comprising a plurality of repeated structures arranged side by side formed from polypropylene.

Clause 6. The method of clause 1, wherein the first face plate and the second face plate each define a hitting surface, and at least a portion of the hitting surface is made from a metallic material.

Clause 7. The method of clause 6, wherein the metallic material is selected from a group consisting of: titanium, aluminum, nickel alloys, and magnesium.

Clause 8. A pickleball paddle comprising: a paddle head subassembly comprising a first hitting surface, a second hitting surface, and a core disposed between the first and second hitting surfaces, wherein the paddle head subassembly further comprises a paddle head subassembly perimeter portion; a frame comprising: a first frame member having a first rim member extending from and integral with a first handle member; a second frame member having a second rim member extending from and integral with a second handle member; wherein the first frame member is coupled to the second frame member with the paddle head subassembly secured therebetween; wherein the paddle head subassembly is joined to the first rim member and the second rim member; wherein the paddle head subassembly is located within, and a perimeter portion of the paddle head subassembly is surrounded by, the first rim member and the second rim member, such that a majority of the first hitting surface and the second hitting surface are exposed; and wherein the paddle head subassembly is not located within nor surrounded by the first handle member and the second handle member.

Clause 9. The pickleball paddle of clause 8, wherein a first face plate and a second face plate of the paddle head subassembly each define the first hitting surface and the second hitting surface, respectively, and at least a portion of each hitting surface comprises a metallic material.

Clause 10. The pickleball paddle of clause 9, wherein the first hitting surface comprises a plurality of laser etched bonding features on a first hitting surface interior surface, and the second hitting surface comprises a plurality of laser etched bonding features on a second hitting surface interior surface.

Clause 11. The pickleball paddle of clause 8, wherein the first frame member and the second frame member are identical.

Clause 12. The pickleball paddle of clause 8, wherein: a plurality of struts is disposed within the core; a plurality of internal pockets is defined by adjacent struts of the plurality of struts; and an elastomeric damping material is disposed in at least one internal pocket of the plurality of internal pockets.

Clause 13. The pickleball paddle of clause 12, wherein the plurality of struts includes a plurality of primary struts extending in a direction parallel to a first axis, a plurality of secondary struts extending in a direction parallel to a second axis different from the first axis, and a plurality of tertiary struts extending in a direction parallel to a third axis different from the first and second axes; wherein the first axis and the second axis intersect to form a first angle between 10 degrees and 130 degrees; and wherein the first axis and the third axis intersect to form a second angle between 80 degrees and 180 degrees.

Clause 14. The pickleball paddle of clause 8, wherein each of the first frame member and the second frame member comprises a frame exterior side and a frame interior side; wherein, when the pickleball paddle is assembled, the frame interior side is not exposed.

Clause 15. The pickleball paddle of clause 14, wherein each of the first frame and the second frame comprises a mating surface connecting the frame interior surface and the frame exterior surface; such that when the pickleball paddle is assembled, each mating surface abuts with an opposite mating surface without gaps or overlap.

Clause 16. The pickleball paddle of clause 15, wherein each frame interior surface comprises a lateral bonding surface extending approximately perpendicular to a respective planar rim surface; and wherein the lateral bonding surface defines a lateral bonding surface height measured perpendicularly from the planar rim surface.

Clause 17. The pickleball paddle of clause 16, wherein each frame further comprises a rim-to-face bonding surface, extending towards a paddle face center and perpendicularly from the lateral bonding surface, offset towards a paddle first or second hitting surface relative to the planar rim surface; and wherein the bonding surface defines a bonding surface width measured perpendicular to the frame interior wall.

Clause 18. The pickleball paddle of clause 17, wherein each frame further comprises an epoxy retention lip extending inward and perpendicular to the bonding surface; and wherein the epoxy retention lip defines an epoxy retention lip height measured perpendicularly from rim-to-face bonding surface.

Clause 19. The pickleball paddle of clause 18, wherein each frame interior surface further comprises a plurality of reinforcing structures.

Clause 20. The pickleball paddle of clause 19, wherein each frame interior surface further comprises a plurality of vertical ribs protruding from the lateral bonding surface and oriented approximately perpendicularly to the bonding surface.

Clause 21. The pickleball paddle of clause 19, wherein each frame comprises a throat portion transitioning between each rim member and each handle member.

Clause 22. A pickleball paddle comprising: a paddle head subassembly having a first face plate and a second faceplate sandwiching a core; a frame comprising: a first frame member having a first rim formed integrally with a first handle, the first rim including a first rim annular wall and a first rim flange wall; a second frame member having a second rim formed integrally with a second handle, the second rim including a second rim annular wall and a second rim flange wall; a frame joint coupling the first rim annular wall to the second rim annular wall with the paddle head subassembly disposed between the first and second frame members, to form a unitary frame structure securing the paddle head subassembly; a first face joint coupling the first faceplate to the first rim flange wall; a second face joint coupling the second faceplate to the second rim flange wall.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to ocm3ur or become more pronounced, however, are not to be construed as critical, required, or essential features or elements of any or all of the claims, unless such benefits, advantages, solutions, or elements are stated in such claim.

As the rules to pickleball may change from time to time (e.g., new regulations may be adopted or old rules may be eliminated or modified by pickleball standard organizations and/or governing bodies such as the United States Pickleball Association (USPA)), pickleball equipment related to the apparatus, methods, and articles of manufacture described herein may be conforming or non-conforming to the rules of pickleball at any particular time. Accordingly, pickleball equipment related to the apparatus, methods, and articles of manufacture described herein may be advertised, offered for sale, and/or sold as conforming or con-conforming pickleball equipment. The apparatus, methods, and articles of manufacture described herein are not limited in this regard.

The above examples may be described in connection with a pickleball paddle. Alternatively, the apparatus, methods, and articles of manufacture described herein may be applicable to other types of sports equipment such as a tennis racquet, a badminton racquet, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A method of assembling a pickleball paddle having paddle head subassembly, the method comprising:

injection molding a first frame member having a first rim member extending from and integral with a first handle member;

injection molding a second frame member having a second rim member extending from and integral with a second handle member;

positioning the paddle head subassembly between the first frame member and the second frame member;

coupling the first frame member to the second frame member with the paddle head subassembly secured therebetween;

wherein the paddle head subassembly is joined to the first rim member and the second rim member;

wherein the paddle head subassembly is located within, and a perimeter portion of the paddle head subassembly is surrounded by, the first rim member and the second rim member such that majorities of a first face plate and a second face plate of the paddle head subassembly are exposed; and wherein paddle head subassembly is not located within nor surrounded by the first handle member and the second handle member.

2. The method of claim 1, wherein the first frame member and the second frame member are joined using adhesives.

3. The method of claim 1, wherein the paddle head subassembly, the first frame member and the second frame member are secured via a method selected from one or more of the following: mechanical fasteners, adhesives, and ultrasonic welding.

4. The method of claim 3, wherein coupling the first frame member and the second frame member comprises mechanically coupling the first frame member to the second frame member.

5. The method of claim 1, wherein a core resembles a honeycomb structure comprising a plurality of repeated structures arranged side by side formed from polypropylene.

6. The method of claim 1, wherein the first face plate and the second face plate each define a hitting surface, and at least a portion of the hitting surface is made from a metallic material.

7. The method of claim 6, wherein the metallic material is selected from a group consisting of: titanium, aluminum, nickel alloys, and magnesium.

8. A pickleball paddle comprising:

a paddle head subassembly comprising a first hitting surface, a second hitting surface, and a core disposed between the first and second hitting surfaces, wherein the paddle head subassembly further comprises a paddle head subassembly perimeter portion;

a frame comprising:

a first frame member having a first rim member extending from and integral with a first handle member;

a second frame member having a second rim member extending from and integral with a second handle member;

wherein the first frame member is coupled to the second frame member with the paddle head subassembly secured therebetween;

wherein the paddle head subassembly is joined to the first rim member and the second rim member;

wherein the paddle head subassembly is located within, and a perimeter portion of the paddle head subassembly is surrounded by the first rim member and the second rim member, such that a majority of the first hitting surface and the second hitting surface are exposed; and wherein the paddle head subassembly is not located within nor surrounded by the first handle member and the second handle member.

9. The pickleball paddle of claim 8, wherein a first face plate and a second face plate of the paddle head subassembly each define the first hitting surface and the second hitting surface, respectively, and at least a portion of each hitting surface comprises a metallic material.

10. The pickleball paddle of claim 9, wherein the first hitting surface comprises a plurality of laser etched bonding features on a first hitting surface interior surface, and the second hitting surface comprises a plurality of laser etched bonding features on a second hitting surface interior surface.

11. The pickleball paddle of claim 8, wherein the first frame member and the second frame member are identical.

12. The pickleball paddle of claim 8, wherein:

a plurality of struts is disposed within the core;

a plurality of internal pockets is defined by adjacent struts of the plurality of struts; and an elastomeric damping material is disposed in at least one internal pocket of the plurality of internal pockets.

13. The pickleball paddle of claim 12, wherein the plurality of struts includes a plurality of primary struts extending in a direction parallel to a first axis, a plurality of secondary struts extending in a direction parallel to a second axis different from the first axis, and a plurality of tertiary struts extending in a direction parallel to a third axis different from the first and second axes;

wherein the first axis and the second axis intersect to form a first angle between 10 degrees and 130 degrees; and wherein the first axis and the third axis intersect to form a second angle between 80 degrees and 180 degrees.

14. The pickleball paddle of claim 8, wherein each of the first frame member and the second frame member comprises a frame exterior side and a frame interior side;

wherein, when the pickleball paddle is assembled, the frame interior side is not exposed.

15. The pickleball paddle of claim 14, wherein each of the first frame and the second frame comprises a mating surface connecting a frame interior surface and a frame exterior surface; such that when the pickleball paddle is assembled, each mating surface abuts with an opposite mating surface without gaps or overlap.

16. The pickleball paddle of claim 15, wherein each frame interior surface comprises a lateral bonding surface extending approximately perpendicular to a respective planar rim surface; and wherein the lateral bonding surface defines a lateral bonding surface height measured perpendicularly from the planar rim surface.

17. The pickleball paddle of claim 16, wherein each frame further comprises a rim-to-face bonding surface, extending towards a paddle face center and perpendicularly from the lateral bonding surface, offset towards a paddle first or second hitting surface relative to the planar rim surface; and wherein the rim-to-face bonding surface defines a bonding surface width measured perpendicular to a frame interior wall.

18. The pickleball paddle of claim 17, wherein each frame further comprises an epoxy retention lip extending inward and perpendicular to the bonding surface; and wherein the epoxy retention lip defines an epoxy retention lip height measured perpendicularly from rim-to-face bonding surface.

19. The pickleball paddle of claim 18, wherein each frame interior surface further comprises a plurality of reinforcing structures.

20. The pickleball paddle of claim 19, wherein each frame interior surface further comprises a plurality of vertical ribs protruding from the lateral bonding surface and oriented approximately perpendicularly to the bonding surface.

* * * * *